US006154189A

United States Patent [19]

Tamura et al.

[11] Patent Number: 6,154,189

[45] Date of Patent: Nov. 28, 2000

[54] LIQUID CRYSTAL DISPLAY PANEL DRIVE METHOD, SEGMENT DRIVER, DISPLAY CONTROLLER AND LIQUID CRYSTAL DISPLAY DEVICE

[75] Inventors: Tsuyoshi Tamura; Hisanobu Ishiyama, both of Suwa, Japan

[73] Assignee: Seiko Epson Corporation, Tokyo, Japan

[21] Appl. No.: 09/028,296

[22] Filed: Feb. 24, 1998

[30] Foreign Application Priority Data

Feb. 27, 1997 [JP] Japan ..... 9-044377
Feb. 6, 1998 [JP] Japan ..... 10-041181

[51] Int. Cl.[7] ..... G09G 3/36

[52] U.S. Cl. ..... 345/89; 345/98; 345/100

[58] Field of Search ..... 345/87, 88–90, 345/91–100, 204

[56] References Cited

U.S. PATENT DOCUMENTS

| | | | |
|---|---|---|---|
| 5,485,173 | 1/1996 | Scheffer et al. . | |
| 5,585,816 | 12/1996 | Scheffer et al. | 345/100 |
| 5,642,133 | 6/1997 | Scheffer et al. | 345/147 |
| 5,689,280 | 11/1997 | Asari et al. | 345/89 |
| 5,767,836 | 6/1998 | Scheffer et al. | 345/147 |
| 5,818,409 | 10/1998 | Furuhashi et al. | 345/94 |
| 5,877,738 | 3/1999 | Ito et al. | 345/94 |
| 5,929,832 | 7/1999 | Furukawa et al. | 345/98 |

FOREIGN PATENT DOCUMENTS

| | | |
|---|---|---|
| 62-183434 | 8/1987 | Japan . |
| 5-100642 | 4/1993 | Japan . |
| 7-199863 | 8/1995 | Japan . |

OTHER PUBLICATIONS

Ruckmonogathan, N.T. and Madhusudana, N.V., "New Addressing Techiques for Multiplexed Liquid Crystal Displays", Proceedings of the SID, vol. 24/3, 1983.

Nehring, Jurgen & Kmetz, Allan R., "Ultimate Limits for Matrix Addressing of RMS–Responding Liquid–Crystal Displays," IEEE Transactions on Electron Devices, vol. Ed—26, No. 5, May 1979.

*Primary Examiner*—Richard A. Hjerpe
*Assistant Examiner*—Kimnhung Nguyen
*Attorney, Agent, or Firm*—Oliff & Berridge, PLC

[57] ABSTRACT

An object of the present invention is to realize the gray shading through PWM in the MLS drive method while minimizing increase of the number of voltage levels and degradation of the display characteristics. A given calculation is performed out by using a gray shades data, a virtual data generated by the gray shades data and an orthogonal function. The resulting data is then used to perform the pulse width modulation to realize the pulse width modulation of binary level in the MLS drive method. The virtual data is generated so that the sum of the number of 1 in the gray shades data and the number of 1 in the virtual data is even number. The gray shades data and virtual data are converted into data symmetrical about 0. The converted data is used with an orthogonal function to perform a matrix calculation with the result thereof being then converted into a positive integer. Alternatively, the gray shades data, virtual data and orthogonal function are used to perform a matrix calculation. An addition is performed based on the result of the matrix calculation together with a constant corresponding to the sum of row elements in the orthogonal function. A display controller may generate PWM data or a segment driver including a memory may generate PWM data.

31 Claims, 30 Drawing Sheets

HIGHER ORDER $$\overset{136}{\begin{pmatrix} -1 & 1 & 1 & 1 \\ 1 & 1 & -1 & 1 \\ 1 & -1 & 1 & 1 \\ 1 & 1 & 1 & -1 \end{pmatrix}} \overset{135}{\begin{pmatrix} 1 \\ 1 \\ -1 \\ -1 \end{pmatrix}} = \overset{137}{\begin{pmatrix} -2 \\ 2 \\ -2 \\ 2 \end{pmatrix}}$$

LOWER ORDER $$\overset{136}{\begin{pmatrix} -1 & 1 & 1 & 1 \\ 1 & 1 & -1 & 1 \\ 1 & -1 & 1 & 1 \\ 1 & 1 & 1 & -1 \end{pmatrix}} \overset{135}{\begin{pmatrix} -1 \\ -1 \\ 1 \\ -1 \end{pmatrix}} = \overset{137}{\begin{pmatrix} 0 \\ -4 \\ 0 \\ 0 \end{pmatrix}}$$

FIG.3
PRIOR ART $$\frac{\overbrace{\sum_{i=:}^{L} \{L \times Di - (N-1) \times L/2\} \times Fi}^{\text{FIRST TERM}} + \overbrace{L \times (N-1) \times L/2}^{\text{SECOND TERM}}}{L}$$

L : NUMBER OF SIMULTANEOUSLY SELECTED LINES

N : NUMBER OF GRAY SHADES

F : ORTHOGONAL FUNCTION

D : GRAY SHADES DATA

FIG.5

COMPARATIVE EXAMPLE

COMPARATIVE EXAMPLE

191

$$\sqrt{\frac{(a+1)^2+n-1}{(a-1)^2+n-1}}$$ (NORMAL MULTIPLEX DRIVE)

191

$$\sqrt{\frac{3(a+1)^2+(a-1)^2+(n-4)}{(a+1)^2+3(a-1)^2+(n-4)}}$$ (4 MLS DRIVE THROUGH LEVEL CHANGE)

193

$$\sqrt{\frac{2.5(a+1)^2+1.5(a-1)^2+(n-4)}{1.5(a+1)^2+2.5(a-1)^2+(n-4)}}$$ (COMPARATIVE EXAMPLE)

a : BIAS RATIO

FIG. 7

$$\frac{\overbrace{\sum_{i=:}^{L} \{2 \times L \times D - (N-1) \times L\} \times Fi}^{\text{FIRST TERM}} + \overbrace{L \times (N-1) \times L/2}^{\text{SECOND TERM}}}{L}$$

L : NUMBER OF SIMULTANEOUSLY SELECTED LINES (LM) + NUMBER OF VIRTUAL DATA

N : NUMBER OF GRAY SHADES

F : ORTHOGONAL FUNCTION

D : GRAY SHADES DATA

FIG.9

| 241 | 243 | 245 | 246 (Ne) |
|---|---|---|---|
| 3 | 11 | 12 | 36 |
| 3 | 11 | 12 | 36 |
| 3 | 11 | 12 | 36 |
| 3 | 11 | 12 | 36 |
| 242 | 244 | | |

| 241 | 243 | 245 | 246 (Ne) |
|---|---|---|---|
| 3 | 11 | 8 | 36 |
| 2 | 10 | 12 | 28 |
| 2 | 10 | 12 | 28 |
| 3 | 11 | 8 | 36 |
| 242 | 244 | | |

| 241 | 243 | 245 | 246 (Ne) |
|---|---|---|---|
| 3 | 11 | 0 | 36 |
| 1 | 01 | 12 | 20 |
| 0 | 00 | 8 | 12 |
| 2 | 10 | 4 | 28 |
| 242 | 244 | | |

| 241 | 243 | 245 | 246 (Ne) |
|---|---|---|---|
| 3 | 11 | 0 | 36 |
| 0 | 00 | 12 | 12 |
| 0 | 00 | 12 | 12 |
| 3 | 11 | 0 | 36 |
| 242 | 244 | | |

| 241 | 243 | 245 | 246 (Ne) |
|---|---|---|---|
| 0 | 00 | 12 | 12 |
| 1 | 01 | 4 | 20 |
| 2 | 10 | 8 | 28 |
| 3 | 11 | 0 | 36 |
| 242 | 244 | | |

FIG. 12

VIRTUAL DATA GENERATION CIRCUIT $$\frac{\sum_{i=:}^{L} \{2 \times L \times Di - (N-1) \times L\} \times Fi + L \times (N-1) \times L/2}{L}$$

$$= \frac{\sum_{i=:}^{L} \{2 \times Di - (N-1)\} \times Fi + (N-1) \times L/2}{1}$$

SUBSTITUTE L=4 N=64

$$= 2(D1 \times F1 + D2 \times F2 + D3 \times F3 + D4 \times F4) - 63\ (F1 + F2 + F3 + F4) + 126$$

$$D4 = K4$$

WHEN $F1 + F2 + F3 + F4 = 2$ $$2\ (D1 \times F1 + D2 \times F2 + D3 \times F3 + K4 \times F4)$$

WHEN $F1 + F2 + F3 + F4 = -2$ $$2\ (D1 \times F1 + D2 \times F2 + D3 \times F3 + K4 \times F4) + 252$$
$$= 2\ \{(D1 \times F1 + D2 \times F2 + D3 \times F3 + K4 \times F4) + 126\}$$

FIG. 16

$$T2 = m \times \left(\frac{LM}{L}\right) \times T1 = \frac{3}{4} T1$$

$$\sqrt{\frac{3(a+1)^2+(a-1)^2+(n\times\frac{4}{3}-1)}{(a+1)^2+3(a-1)^2+(n\times\frac{4}{3}-1)}}$$

(PRESENT EMBODIMENT)

FIG. 27

LIQUID CRYSTAL DISPLAY PANEL DRIVE METHOD, SEGMENT DRIVER, DISPLAY CONTROLLER AND LIQUID CRYSTAL DISPLAY DEVICE

BACKGROUND OF THE INVENTION

1. Field of Industrial Application

The present invention relates to a multi-line selection drive method which can realize the gray shading. More particularly, the present invention concerns a segment driver for driving a liquid crystal display panel through the multi-line selection drive method, a display controller and a liquid crystal display device.

2. Prior Art

In passive matrix type liquid crystal display panels, it is desirable that it takes a liquid crystal material having its increased speed of response for dealing with the display of animation. However, if the speed of response in the liquid crystal increases, there is caused a phenomenon known as a frame response which leads to such a problem as flicker or reduction of contrast. To overcome such a problem, there is one conventional technique known as a multi-line selection drive method (MLS) for simultaneously selecting a plurality of scanning electrodes.

In the MLS selection drive method, the gray shading has been generally realized by the frame rate control (FRC). However, the frame rate control tends to produce the flicker. To overcome such a problem, there have been proposed the pulse width modulation as in Japanese Patent Laid-Open No. 5-100642 or Japanese Patent Laid-Open No. 7-199863 and the voltage modulation. The pulse width modulation (PWM) of the prior art in the MLS will now be described with reference to FIGS. 1A to 4 of the accompanying drawings.

Four gray shades in the simultaneous selection of two lines will first be described. Four gray shades can be represented by gray shades data of two bits. As shown in FIG. 1A, it is now assumed that the gray shades data in pixels 133 and 134 at the intersection between a scanning electrode 131 and a signal electrode 132 is (01). If the OFF and ON states of a liquid crystal are respectively designated 1 and −1, "0" being the higher order bit in the gray shades data (01) will be represented by "1" and "1" being the lower order bit will be represented by −1. As shown in FIG. 1B, this prior art divides the gray shades data into the higher and lower order parts to perform the matrix calculation for the gray shades data and the orthogonal function (e.g., a matrix represented by 1 and −1). More particularly, the gray shades data at the pixels 133 and 134 is divided into the higher and lower order bits as shown by 135. The matrix calculation for each of these higher and lower order bits and the orthogonal function 136 is then performed. The matrix calculation provides two results 137 which are separately outputted toward first and second fields (which will respectively be referred to 1*f* and 2*f*). The results of the matrix calculation take one of the values 2, 0 and −2. Each result is then outputted toward a segment (signal electrode) depending on the voltage level Vx, 0 or −Vx. The voltage waveform in the segment output is shown in FIG. 2. Reference numeral 141 represents voltage level at the segment output; 142 times axes; and 143 and 144 fields. As shown in FIG. 2, a section a shown by 145 has a length two times longer than another section b shown by 146. In other words, the pulse width corresponding to the higher order bit in the gray shades data is two times the pulse width corresponding to the lower order bit.

For simplification, FIG. 2 shows as if continuous between the pulse corresponding to the lower order bit in the field 1*f* and the pulse corresponding to the higher order bit in the field 2*f*, but the pulses are actually separated from each other.

Next, four gray shades in the simultaneous selection of four lines will be described. FIG. 3 shows the process of calculation in this case. With the simultaneous selection and drive of four lines, the result 137 of the matrix calculation for the orthogonal function 136 may take any one of values 4, 2, 0, −1 and −4. Each of these results will be outputted toward the segment depending on the voltage level of 2Vx, Vx, 0, −Vx or 2Vx. The voltage waveform in this segment output ass shown in FIG. 4. For simplification, FIG. 4 also shows to be continuous between the pulses corresponding to the lower and higher order bits in the fields 1*f* and 2*f*, respectively.

However, such a prior art technique raises the following problem as the number of gray shades and lines to be simultaneously selected increases. As the number of gray shades increases, the number of transitions C1 to C7 in FIG. 4 correspondingly increases. The difference between the voltage levels as well as the orientation of variation in the segment waveform variation at the transitions C1 to C7 become random. The distortion of the segment waveform as well as the magnitude and orientation of noise superimposed on the common (scanning electrode) in the variation of segment waveform also become random. Such a noise causes a crosstalk resulting in great reduction of the quality in display. To overcome such a crosstalk, there may be considered a technique used with the idea of Japanese Patent Laid-Open No. 62-183434 for offsetting the noise by changing the position of pulse division in the PWM backward and forward, for example, for each frame. However, it is difficult to apply such a technique to the prior art since in the prior art the position of transition, the difference between voltage levels in the variation of the waveform at the transition and the orientation of variation are random.

In this prior art, further, the number of voltage levels also increases as the number of lines to be simultaneously selected increases. For example, the simultaneous selection of four lines requires five voltage levels while the simultaneous selection of five lines requires six voltage levels. As the number of voltage levels increases, the number of power supplies required by the system also increases. This further results in increase of the number of output transistor elements in the segment driver with a control circuit for each output transistor. This increases the manufacturing cost.

SUMMARY OF THE INVENTION

In view of the technical problems of the prior art, an object of the present invention is to provide a liquid crystal display panel drive method, segment driver, display controller and liquid crystal display device, which can realize the gray shading through PWM in the MLS drive method while minimizing the number of voltage levels and the degradation of display characteristics such as contrast.

To this end, the present invention provides a method of driving a liquid crystal display panel having scanning electrodes and signal electrodes through the multi-line selection drive method for simultaneously selecting a plurality of scanning electrodes, comprising the steps of:

generating a virtual data based on a gray shades data corresponding to the plurality of scanning electrodes to be simultaneously selected;

performing a given calculation based on the gray shades data, the virtual data and an orthogonal function defining signals to be given to the scanning electrodes; and pulse width modulating signals to be given to the signal electrodes during a selected period based on the resulting data from the given calculation.

The virtual data is provided by the gray shades data. Based on the gray shades data, virtual data and orthogonal function, a given calculation is performed to make the pulse width modulation (PWM), based on the resulting data. Thus, the gray shading can be realized through PWM in the MLS drive method while minimizing the number of voltage levels used. By introducing the concept of virtual data, the degradation of display characteristics such as contrast can be minimized with an appropriate and reproducible PWM data being provided, while realizing the gray shading through the PWM having the reduced number of voltage levels.

According to the method of the present invention, the virtual data may be generated so that the sum of one of the number of 1 and 0 for each bit of the gray shades data which is binary represented and one of the number of 1 and 0 for each corresponding bit of the virtual data which is binary represented is even number. By generating the virtual data in such a manner, the appropriate and reproducible PWM data can be formed for all the gray shades data.

According to the method of the present invention, data from the given calculation may be obtained by converting the gray shades data and the virtual data into a data symmetrical about 0, performing a matrix calculation based on the converted data and an orthogonal function of i row and j column (wherein i and j are positive integers) and converting the result of the matrix calculation into a data represented only by a positive integer. Thus, an appropriate PWM data for the gray shades data can be obtained. However, it is not necessarily required to perform such conversions actually by using circuits or the like. What may be required is that the resulting data from a given calculation is the same as the data provided by such conversions.

The conversion of the gray shades data and the virtual data into a data symmetrical about 0 may include a conversion in which the ray shades data and the virtual data is multiplied by $2\times L$ and $(N-1)\times L$ is subtracted from the resulting value when it is assumed that the number of gray shades is N and an added number of scanning electrodes to be simultaneously selected and virtual data is L. The conversion of the result of the matrix calculation into a data represented only by the positive integer may include a conversion in which $L\times(N-1)\times L/2$ is added to the result of the matrix calculation and the resulting value being divided by L when it is assumed that the number of gray shades is N and an added number of scanning electrodes to be simultaneously selected and virtual data is L.

The present invention further provides a method of driving a liquid crystal display panel in which the given calculation may comprise:

a matrix calculation based on the gray shades data, the virtual data and an orthogonal function of i row and j column (wherein i and j are positive integers); and an add calculation based on a result of the matrix calculation and a constant depending on the total sum of the row elements of the orthogonal function. Thus, the given calculation can be realized through a small-scale and simple circuit or the like.

The constant depending on the total sum of the row elements in the orthogonal function may be $-(N-1)\times S+N-1)\times L/2$ when it is assumed that the total sum of the row elements in the orthogonal function is S and the number of gray shades is N.

The number of time divisions in the pulse width modulation during the selected period may be (N−1) when it is assumed that the number of gray shades is N and a sum of the number of scanning electrodes to be simultaneously selected and the number of virtual data is L which is equal to four. The resulting PWM data can be multiple of four when L is equal to four. By using a data obtained by reducing the PWM data with four, the number of time divisions during the selected period can be reduced from $(N-1)\times L=(N-1)$ to (N−1). As a result, the frequency of division clock for time dividing the selected period can be reduced to decrease the operational speed of the segment driver or the like and to save the power.

The present invention further provides a segment driver for driving signal electrodes through a multi-line selection drive method for simultaneously selecting a plurality of scanning electrodes, comprising:

means for generating a virtual data based on a gray shades data corresponding to the plurality of scanning electrodes to be simultaneously selected;

means for performing a given calculation based on the gray shades data, the virtual data and an orthogonal function defining signals to be given to the scanning electrodes; and means for pulse width modulating signals to be given to the signal electrodes during a selected period based on the resulting data from the given calculation.

Thus, the present invention can provides a segment driver which can realize the gray shading through PWM in the MLS drive method while minimizing the number of voltage levels and the degradation of display characteristics.

It is preferable that the segment driver further comprises a line memory for holding the gray shades data corresponding to lines equal to or more than two lines LM which is the number of scanning electrodes to be simultaneously selected. Thus, the write and read of the gray shades data relative to the line memory can be performed parallel.

The means for generating the virtual data may comprise:

a logic circuit for performing AND operation of a pulse signal delayed by a specific period relative to the read timing of the line memory and an output signal from the line memory; and a toggle flip-flop initialized before the matrix calculation through the orthogonal function is started, the toggle flip-flop having a clock terminal for receiving the output of the logic circuit and an output terminal for outputting the virtual data. There is thus provided a simplified circuit for generating the virtual data such that the sum of the number of bits 1 or 0 in the gray shades data and the number of bits 1 or 0 in the virtual data will be an even number.

The present invention further provides a display controller for supplying signals to a segment driver for driving signal electrodes and a common driver for driving scanning electrodes through the multi-line selection drive method which simultaneously selects a plurality of scanning electrodes, the display controller comprising:

means for fetching a gray shades data;

means for writing the fetched gray shades data into a line memory which is able to hold a gray shades data corresponding to lines equal to or more than two times the number of simultaneously selected scanning electrodes;

means for reading the written gray shades data from the line memory;

means for generating a virtual data based on a gray shades data corresponding to a plurality of simultaneously selected scanning electrodes;

means for performing a given calculation based on the gray shades data, the virtual data and an orthogonal function defining signals to be given to the scanning electrodes;

means for supplying the resulting data from the given calculation to the segment driver which pulse width modulates signals to be given to the signal electrodes during a selected period based on the resulting data; and means for supplying the orthogonal function to the common driver.

Thus, the present invention can provide a display controller which can realize the gray shading through PWM in the MLS drive method while minimizing the number of voltage levels and the degradation of display characteristics.

T2 may be m×(LM/L)×T1 (m being a positive integer) when it is assumed that LM is the number of simultaneously selected scanning electrodes; L is the sum of LM and the number of virtual data; T1 is a cycle time for writing the gray shades data into the line memory; and T2 is a cycle time for outputting data to the segment driver. Thus, a process of writing the gray shades data into the line memory and process of reading the gray shades data from the line memory and performing the given calculation relative to the read gray shades data to form a PWM data which is in turn outputted toward the segment driver can be accomplished in an effective manner.

The present invention further provides a liquid crystal display device for driving a liquid crystal display panel through the multi-line selection drive method simultaneously selecting a plurality of scanning electrodes, the liquid crystal display device comprising:

a liquid crystal display panel having scanning and signal electrodes;

a segment driver as defined in claim 9 for driving the signal electrodes; and a common driver for driving the scanning electrodes. In such an arrangement, a gray shades data from the conventional display controller can be inputted directly into the segment driver to realize the gray shading through PWM in the MLS drive method.

The present invention further provides a liquid crystal display device for driving a liquid crystal display panel through the multi-line selection drive method simultaneously selecting a plurality of scanning electrodes, the liquid crystal display device comprising:

a liquid crystal display panel having scanning and signal electrodes;

a segment driver for driving the signal electrodes through the pulse width modulation;

a common driver for driving the scanning electrodes; and a display controller as defined in claim 15 for supplying signals to the segment driver and the common driver. In such an arrangement, there may be provided a liquid crystal display device most suitable for use in the complete dispersion drive or half-dispersion drive.

BRIEF DESCRIPTION OF THE DRAWINGS

FIG. 3 is a view illustrating a calculation process in the prior art when four lines are simultaneously selected.

FIG. 5 is a view illustrating a calculating formula in a comparative example.

FIG. 7 is a view illustrating a calculating a ratio of ON/OFF in the prior art or comparative example.

FIG. 9 illustrates a calculating formula used in one embodiment of the present invention.

FIG. 12 is a view illustrating a process of generating a virtual data.

FIG. 16 illustrates a simplification of the calculating formula.

FIG. 27 illustrates a formula calculating a ratio of ON/OFF according to the present embodiment.

DESCRIPTION OF THE PREFERRED EMBODIMENTS

A preferred embodiment of the present invention will now be described in detail with reference to the drawings.

1. Comparative Example

The inventor has proposed a drive method for realizing the gray shading through PWM in the MLS drive method while holding the number of voltage levels two (or three if an intermediate level in the OFF display is considered), as described in Japanese Patent Application NO. 8-288772. This proposal will be described with reference to FIGS. 5 and 6 as a comparative example.

Where the number of simultaneously selected lines is L, the number of gray shades is N and an orthogonal function is F, a gray shades data D can be converted into a data enabling the PWM drive of two levels according to a calculating formula shown in FIG. 5. A case when two line are simultaneously selected with four gray shades (L=2 and N=4) will now be described. The gray shades data are represented by 0, 1, 2 and 3.

The calculating formula of FIG. 5 has a first term including $L\times D-(N-1)\times L/2$ term which is used to convert the gray shades data into data symmetrical about 0. This term is used to convert the gray shades data 0, 1, 2 and 3 into −3, −1, 1 and 3 which are data symmetrical about 0. Σ in the first term means the total sum of the resulting data from the $L\times(D-(N-1)\times L/2$ term and the orthogonal function F for each row in the matrix calculation.

The calculating formula also has a second term including $(N-1)\times L/2$ term which is used to provide a data of positive integer by returning the gray shades data deviated to minus side in the first term back to plus side. This term is multiplied by L to return the data back to plus side by the number of L additions through Σ in the first term. Denominator L in the calculating formula of FIG. 5 is used to compensate the gray shades data multiplied by L in the first term. In the comparative example, the number of time divisions during a selected period (or a time period through which a voltage is applied to signal electrodes) is equal to $(N-1)\times L$.

By performing PWM conversion based on the resulting data from the calculating formula of FIG. 5, the gray shading can be made through PWM of two levels in the MLS drive method.

However, the comparative example raises a problem in that a ratio of ON/OFF which is a ratio of the effective voltage when the liquid crystal is ON to the effective voltage when the liquid crystal is OFF cannot be satisfied.

Figure 1A:
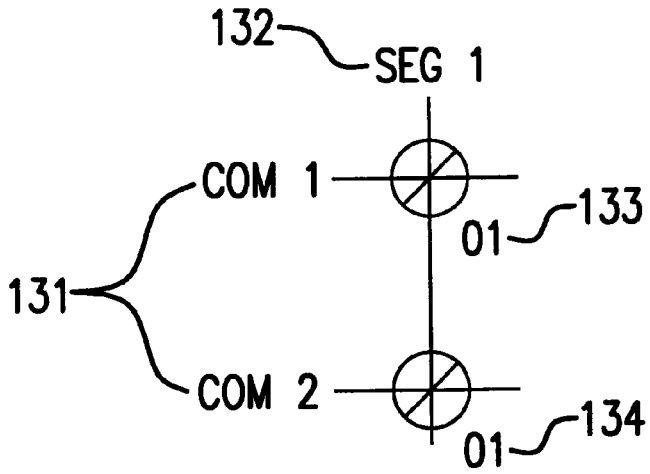
FIG. 1A PRIOR ART
FIGS. 1A and 1B are view illustrating the calculation process in the prior art when two lines are simultaneously selected.
Figure 1B:
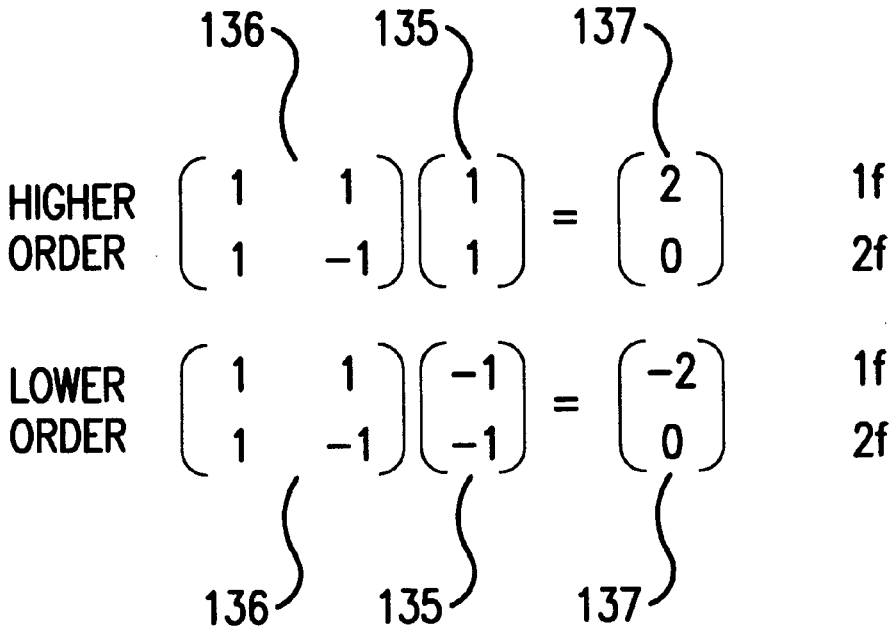
FIG. 1B PRIOR ART
Figure 2:
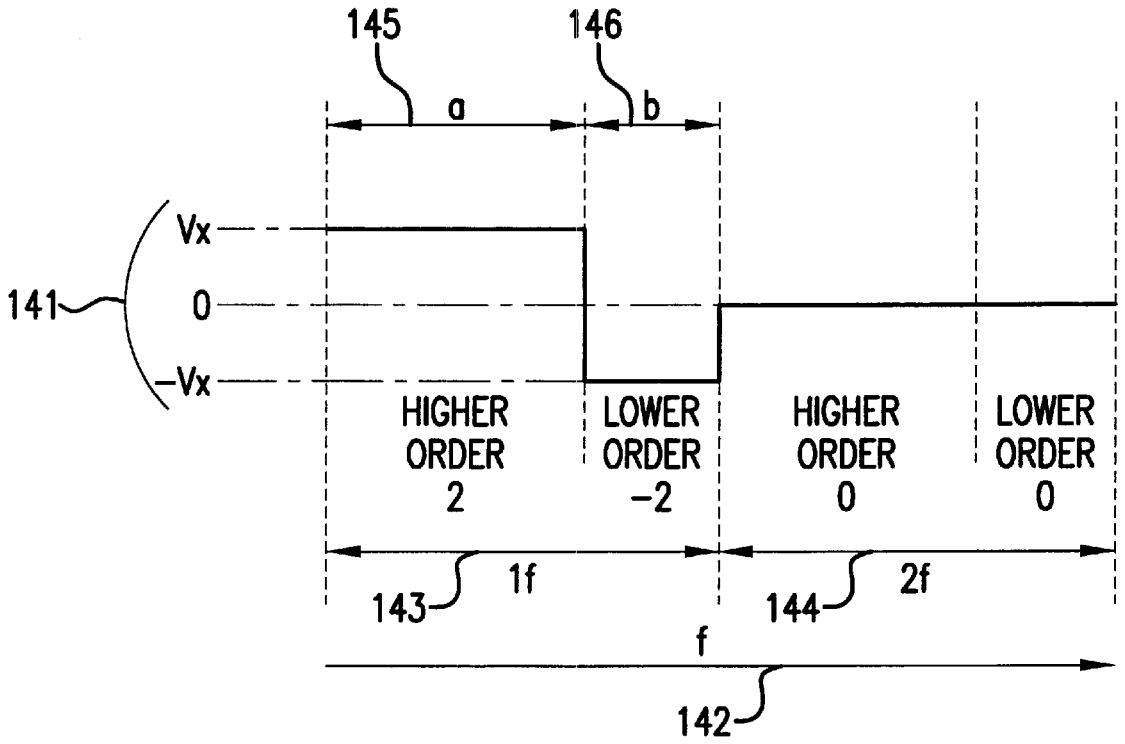
FIG.2 PRIOR ART
FIG. 2 is a view showing a drive waveform in the prior art when two lines are simultaneously selected.
Figure 4:
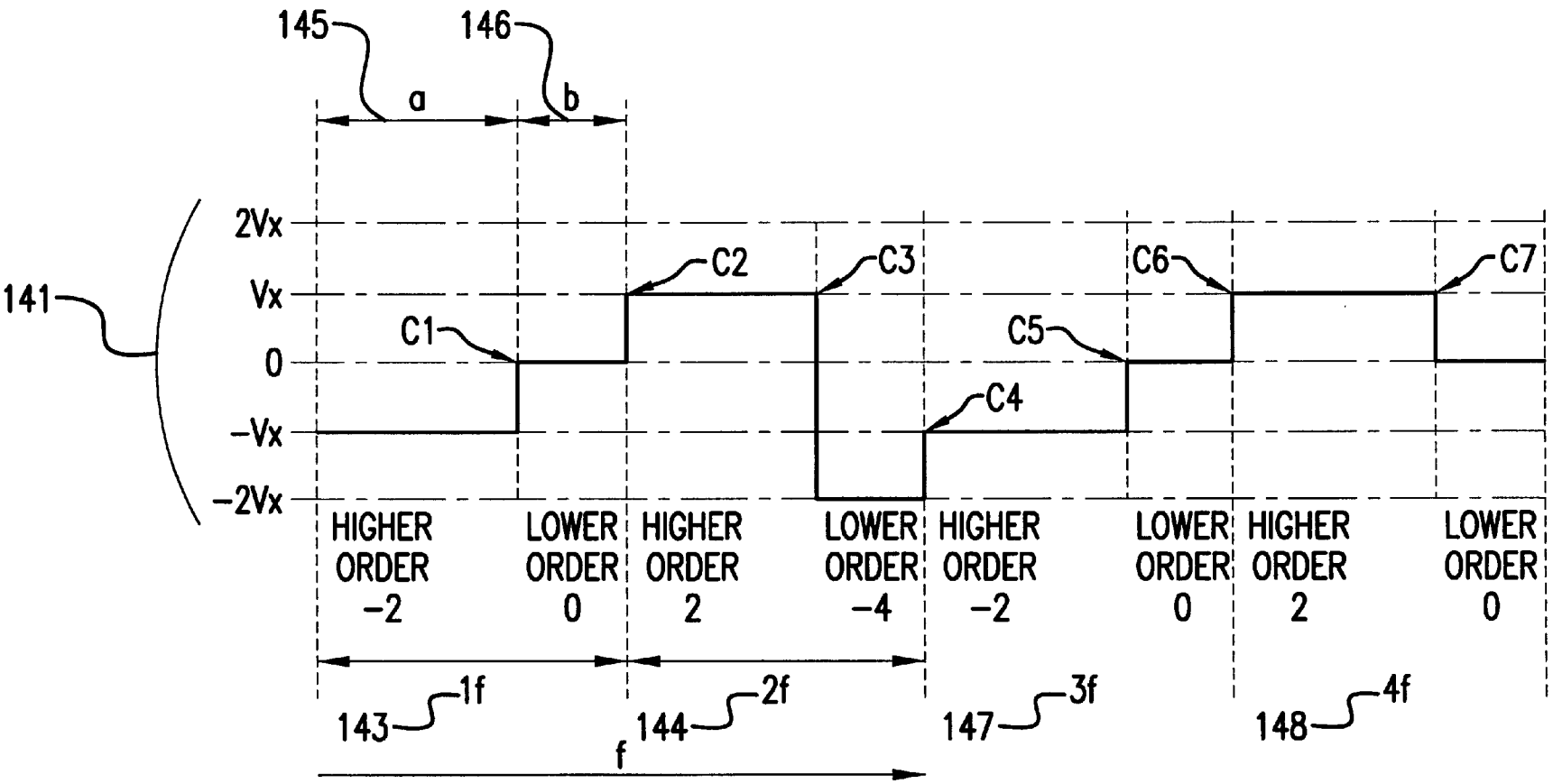
FIG. 4 PRIOR ART
FIG. 4 is a view showing a drive waveform in the prior art when four lines are simultaneously selected.
Figure 6:
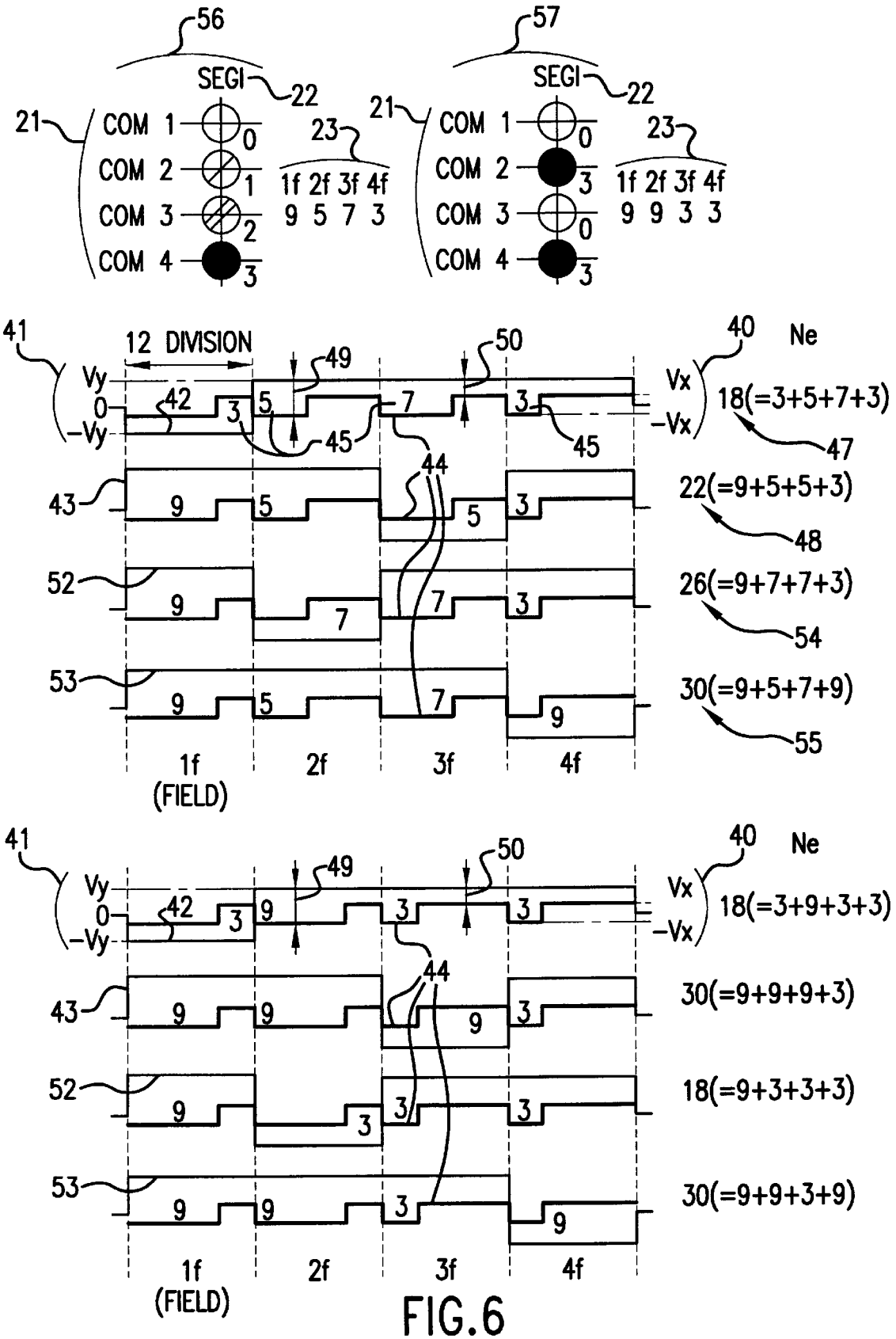
FIG. 6 is a view showing a drive waveform in the comparative example when four lines are simultaneously selected.

FIG. 6 exemplifies segment and common waveforms when four lines are simultaneously selected with four gray shades based on the resulting data from the calculating formula of FIG. 5. The states of gray shades in pixels are represented by black, double-hatched, single-hatched and white circles. The double-hatched circle represents a gray color almost similar to black color while the single-hatched circle represents a gray color almost similar to white color. 21 denotes commons (scanning electrode) and 22 segments (signal electrode). 56 designates display patterns in which the gray shades data of each pixel is 0, 1, 2 and 3 while 57 designates display patterns in which the gray shades data of each pixel is 0, 3, 0 and 3. 23 shows the result of the calculating formula in FIG. 5 for each field. 40 denotes voltage levels at segments while 41 denotes voltage levels at commons. Thin lines 42, 43, 52 and 53 show common waveforms while bold lines 44 show segment waveforms. An effective value applied to the liquid crystal is determined by a difference between common and segment waveforms. Where it is assumed that common voltage levels are Vy, 0 and −Vy and that segment voltage levels are Vx and −Vx, it may be counted that 49 of FIG. 6 is a voltage (Vy+Vx) turning the liquid crystal on and 50 is a voltage (Vy−Vx) turning the liquid crystal off.

In this comparative example, the number of time divisions during the selected period is $(N-1)\times L=12$. Where it is assumed that the selected period divided by the number of time divisions 12 is one divisional unit, the length of the selected period is divided into 12 units. The total length of selected periods 1*f*, 2*f*, 3*f* and 4*f* is divided into 48 units. The gray shades can be represented by the Ne which is the number of divisional units representing the total period through which the liquid crystal continues to be ON (or the period through which the difference between common and segment waveforms be a voltage (Vy+Vx)). The calculated results of Ne are shown in FIG. 6 on the right side of the respective waveforms. As shown by 45 in FIG. 6, for example, the period through which continues to maintain the liquid crystal ON in the waveform on the first line includes the number of divisional units equal to 3, 5, 7 and 3, respectively. Therefore, Ne representing the sum of these divisional units becomes 3+5+7+3=18 as shown by 47 in FIG. 6. Similarly, as shown by 48, 54 and 55, Ne respectively becomes 9+5+5+23=22, 9+7+7+3=26 and 9+5+7+9=30 in the second, third and fourth lines. In other words, 18 divisional units among 48 divisional units contribute to place the the liquid crystal ON in the first waveform in which the gray shades becomes 0. Similarly, 22, 26 and 30 divisional units respectively contribute to place the liquid crystal ON in the second, third and fourth lines in which the gray shades is 1, 2 and 3.

As can been seen from FIG. 6, Ne is variable depending on the size of the gray shades data for each pixel. For example, Ne for the gray shades 3 (black circle) equals to 30. This is larger than Ne for the gray shades 0 (white circle) which equals to 18. In pixels having the same gray shades, Ne is invariable without dependent on the display pattern. In both the display patterns shown by 56 and 57 in FIG. 6, for example, Ne's for the gray shades 3 (black circle) and 0 (white circle) may always be equal to 30 and 18, respectively.

The period contributing to ON for the gray shades 3 is Ne=30 divisional units while the period contributing to OFF is 48−Ne=18 divisional units. On the other hand, the period contributing to ON for the gray shades 0 is Ne=18 divisional units while the period contributing to OFF is 48−Ne=30 divisional units. To realize a ratio of ON/OFF substantially equal to that of the multi-line drive with four lines (which will be referred to 4MLS drive) through the conventional level change, it is required that 30 and 18 are changed to 36 and 12, respectively.

191, 192 and 192 in FIG. 7 respectively show a formula used to calculate a ratio of ON/OFF in the normal multi-plex drive, a formula used to calculate a ratio of ON/OFF in the 4MLS drive through the conventional level change and a formula of calculating a ratio of ON/OFF in the comparative example. In these calculating formulas, a represents a ratio of common side drive voltage to segment side drive voltage (which will be referred to "bias ratio"). (n−4) and (n−1) correspond to effective values applied to the liquid crystal during a non-selected period.

Figure 8:
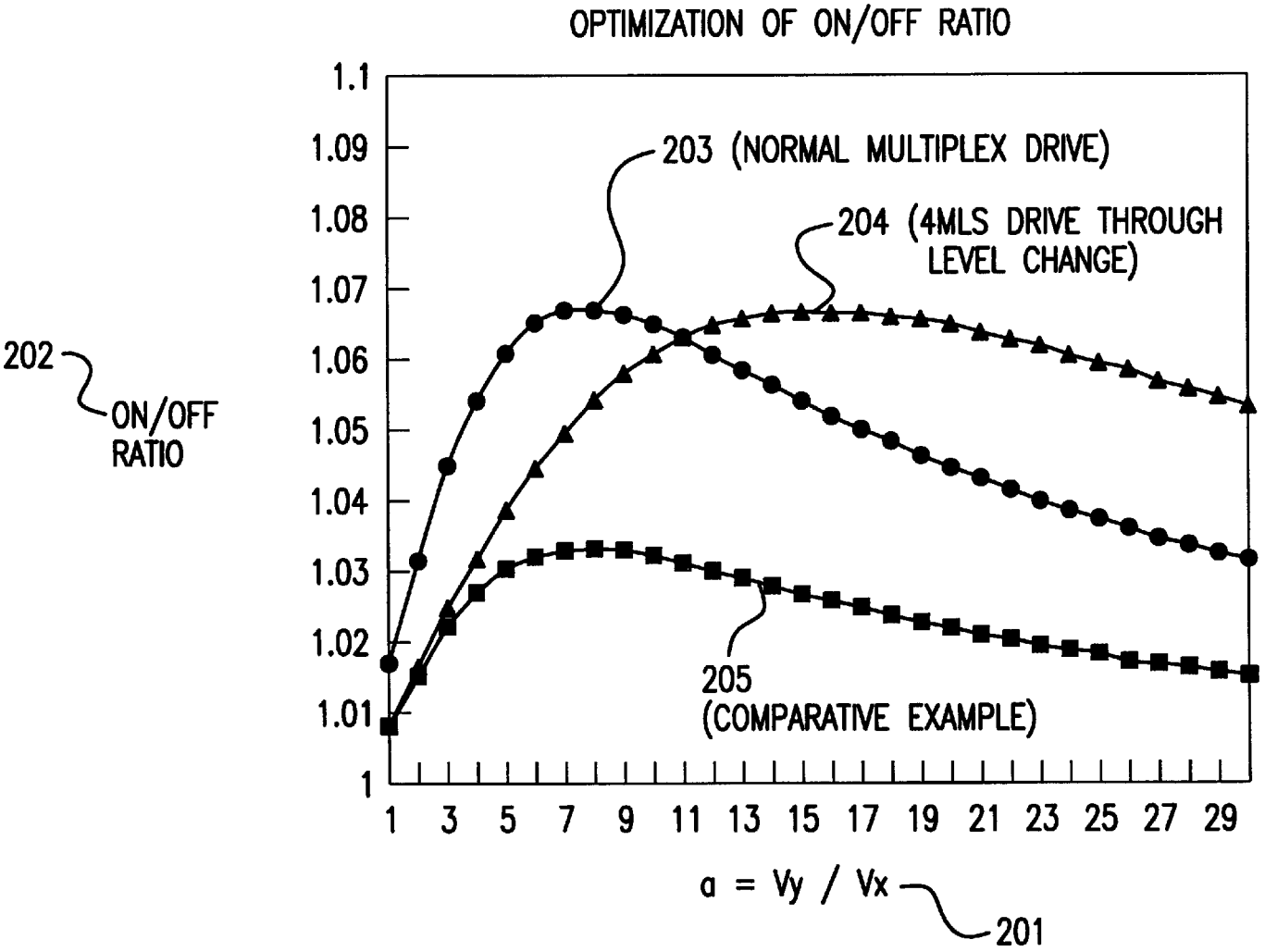
FIG. 8 is a graph representing the ON/OFF ratio characteristics in the prior art or comparative example.

FIG. 8 shows a graph representing the characteristics of ON/OFF ratio when the number of scanning lines is equal to 240 (n=240). Numerals, 203, 204 and 205 respectively show the characteristics of the normal multi-plex drive, the characteristics of the 4MLS drive through the level change and the characteristics of the comparative example drive. From this graph, in the normal multi-plex drive, the ON/OFF ratio becomes maximum, 1.067, when the bias ratio is in the range between 15 and 16. In the 4MLS drive through the level change, the ON/OFF ratio becomes maximum, 1.067, when the bias ratio is in the range between 7 and 8. In the comparative example drive, the ON/OFF ratio becomes maximum when the bias ratio is in the range between 7 and 8, but this maximum value is only 1.034. The ON/OFF ratio of 1.034 extremely reduces the contrast in the liquid crystal display panel. With the actual estimation of the contrast, it was 31.7 in the normal multi-plex drive, but reduced to 10.8 in the comparative example.

In order to overcome the problem relating to the reduction of contrast as in the comparative example, the inventor has devised such as drive method as will be described below.

2. Calculating Formulas

FIG. 9 shows a calculating formula for accomplishing the drive method according to the present embodiment. It is now assumed that simultaneously selected number (LM) plus the number of virtual data is L, the number of gray shades is N, the orthogonal function is F and the gray shades data is D. A case when simultaneously selected number is three and the number virtual data is one with four gray shades (L=4 and N=4) will be described. The gray shades data are represented by 0, 1, 2, and 3.

The calculating formula of FIG. 9 includes a first term containing $2\times L\times D-(N-1)\times L$ term which is used to convert the gray shades data into data symmetrical about 0. By using such a term, the gray shades data 0, 1, 2 and 3 are respectively converted into data −12, −4, 4 and 12 which are symmetrical about 0. Although the comparative example has been described as to conversion into −3, −1, 1 and 3, the embodiment of FIG. 9 provides conversion into −12, −4, 4 and 12. Σ in the first term means the total sum of the resulting data from the $2\times L\times D-(N-1)\times L$ term and the orthogonal function F for each row in the matrix calculation.

The calculating formula of FIG. 9 also includes a second term containing $(N-1)\times L/2$ term which is used to provide a data of positive integer by returning the gray shades data deviated to minus side in the first term back to plus side. This term is multiplied by L to return the data back to plus side by the number of L additions through Σ in the first term. Denominator L in the calculating formula of FIG. 9 is used to compensate the gray shades data multiplied by L in the first term.

Figure 10:
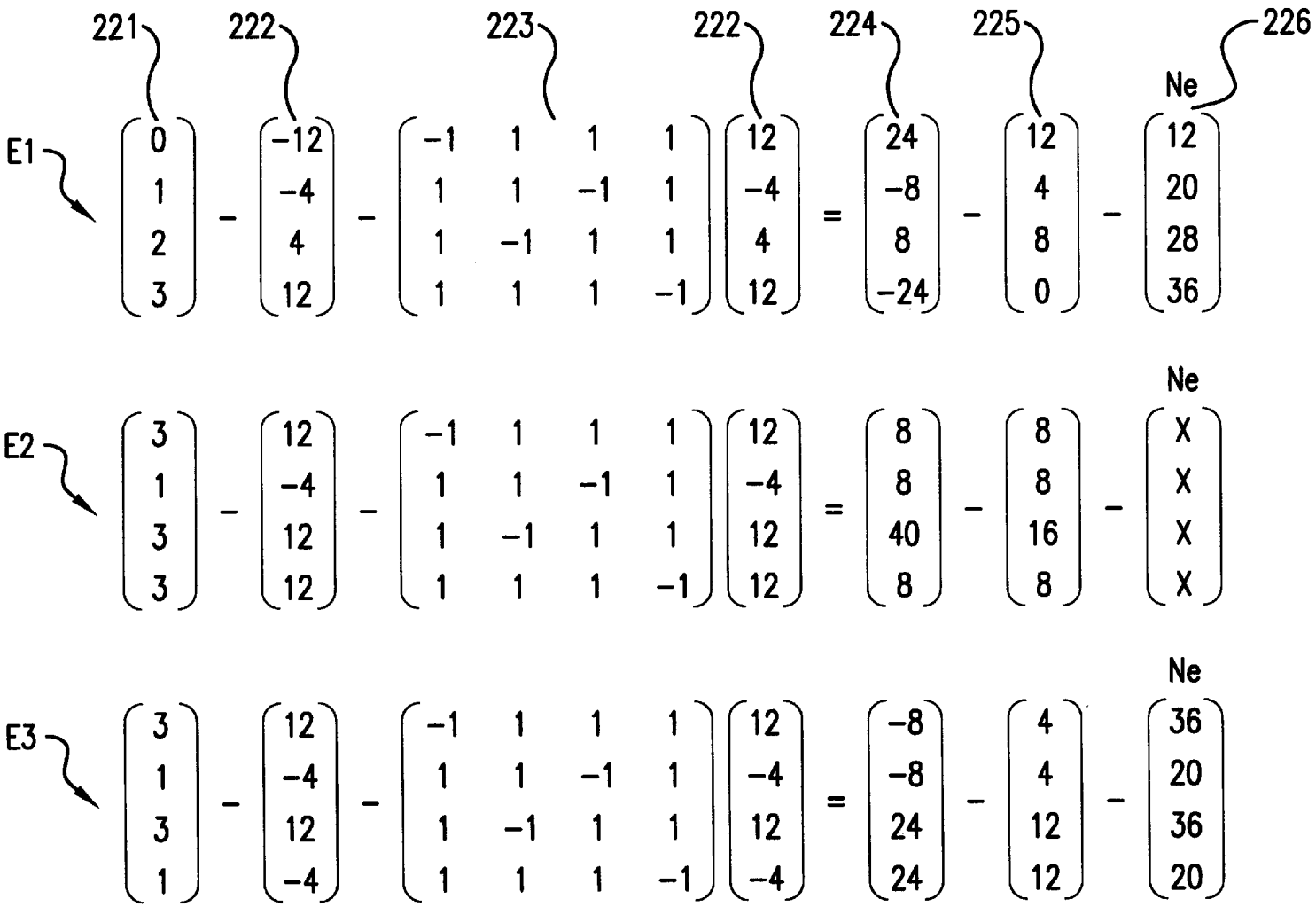
FIG. 10 is a view illustrating a calculation process of the present embodiment when three lines are simultaneously selected.

FIG. 10 exemplifies the process of an calculation according to the calculating formula of FIG. 9. E1 of FIG. 10 in which any virtual data is not used will first be described.

221 denotes the gray shades data. 222 designates the result from calculation of the $2\times L\times D-(N-1)\times L$ term in the calculating formula of FIG. 9. If L=4 and N=4, the gray shades data is multiplied by eight and then subtracted by 12. Thus, the gray shades data will be converted into a data symmetrical about 0. 223 shows the orthogonal function. 224 is the result of the matrix calculation. 225 designates the result 224 of the matrix calculation after it is added by $L\times(N-1)\times L/2=24$ in the second term of FIG. 9 with the added result being then divided by L=24. 226 denotes Ne that corresponds to the total period which contributes to maintain the liquid crystal ON.

If the gray shades data 221 are 0, 1, 2 and 3 sequentially starting from the top, the calculation result 225 will be 12, 4, 8 and 0. Ne corresponding to the sum of the periods which contribute to ON in the liquid crystal will be 12, 20, 28 and 36 sequentially starting from the top. Namely, the gray shades data 0, 1, 2 and 3 corresponds to 12, 20, 28 and 36, respectively. In the present embodiment, thus, 18 in the comparative example (see 47 in FIG. 6) is improved to 12 while 30 in the comparative example (see 55 in FIG. 6) is improved to 36. Therefore, the present embodiment can provide the ON/OFF ratio substantially equal to that of the 4MLS drive through the level change of the conventional art. This may improve the contrast.

E2 of FIG. 10 in which no virtual data is similarly used will be described. If the gray shade data are 3, 1, 3, 3, the results of calculation 225 will be 8, 8, 17 and 8, respectively. However, the number of divisional units during the selected period will be $(N-1)\times L=12$. Consequently, there is raised a problem in that 16 obtained as the result of calculation 225 cannot be converted into PWM data. Although the result of calculation 225 corresponding to the gray shades data 3 is 0 in E1 of FIG. 10, the result of calculation 225 corresponding to the same gray shades data 3 becomes 8 in E2 of FIG. 10. In other words, even the pixels having the same gray shades will have the results of calculation different from one another, depending on the display pattern.

3. Virtual Data

To overcome such a problem, the present embodiment introduces the concept of a virtual data. More particularly, for example, the liquid crystal display panel is driven through 3 MLS (simultaneous three-line selection) while the matrix calculation is performed through the same manner as that of the 4MLS. In other words, the matrix calculation is executed after the virtual data has been added to the gray shades data corresponding to three lines simultaneously selected.

Figure 11:
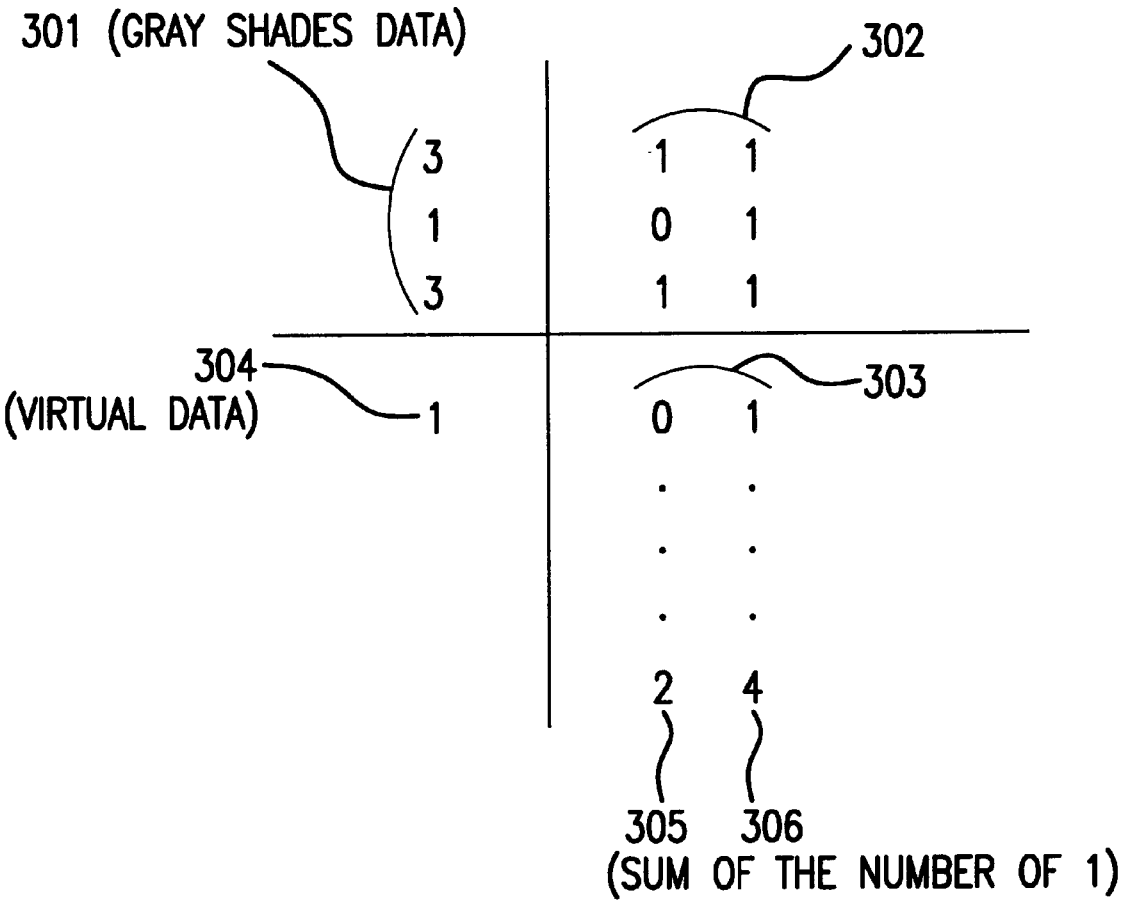
FIG. 11 is a view illustrating a process of generating a virtual data.

A technique of generating a virtual data will be described with reference to FIG. 11. 301 denotes gray shades data; 302 the binary representation of the gray shades data; 304 a virtual data; and 303 the binary representation of the virtual data. The virtual data 301 is generated based on the gray shades data 301. If the gray shades data are 3, 1, and 3, the binary representation of these gray shades data will be (11), (01) and (11), respectively. As shown in FIG. 11, the virtual data is generated for the respective higher and lower order bits so that the sum of the number of 1 (or 0) for each bit in the gray shades data plus the number of 1 (or 0) for each bit in the virtual data will be even. 305 denotes the sum of the number of 1 in the higher order while 306 designates the sum of the number of 1 in the lower order. As shown in FIG. 11, the binary representation of the virtual data becomes (01). Namely, the virtual data becomes one.

E3 of FIG. 10 shows the calculation by adding the above-mentioned virtual data 1 to the gray shades 3, 1 and 3 corresponding to three lines. The result of calculation 225 will be 4, 5, 12 and 12. Ne corresponding to sum of the periods will contribute to ON in the liquid crystal will be 36, 20, 36 and 20. Although E2 of FIG. 10 raises a problem in that the results of calculation 225 contain values which cannot be converted to PWM data, E3 of FIG. 10 will not raise such a problem. The pixels having the same gray shades can always have the same Ne without dependent on the display pattern.

FIG. 12 shows the process of generating virtual data for various data shades data. 241 denotes gray shades data; 242 virtual data; 243 the binary representation of the gray shades data; 244 the binary representation of the virtual data; 245 results of calculation (225 in FIG. 10); and 246 Ne. As can be seen from the binary representations 243 and 244, the virtual data are generated so that the sum of bits 1 (or 0) will always be even. Ne corresponding to the gray shades data 3, 2, 1 and 0 are always 36, 28, 20 and 12 respectively. Therefore, this provides the reproducibility.

As shown in FIG. 12, the results of calculation 245 are always multiple of four. Thus, it is not necessarily required that the number of time divisions during the selected period is $(N-1)\times L=12$, but may be 12/4=3. In other words, with L=4, the number of time divisions during the selected period may be $(N-1)\times L/4=N-1$. Such a division of the number of time divisions by four corresponds to that the denominator L in the calculating formula of FIG. 9 is made 4×L. By reducing the number of time divisions during the selected period, the frequency of division clock used in PWM can be lowered. This enables the power consumption and manufacturing cost to be reduced. The reason why the denominator in the calculating formula of FIG. 9 is not 4×L is to simplify the statement relating to the comparative example.

4. Waveforms

Figure 13:
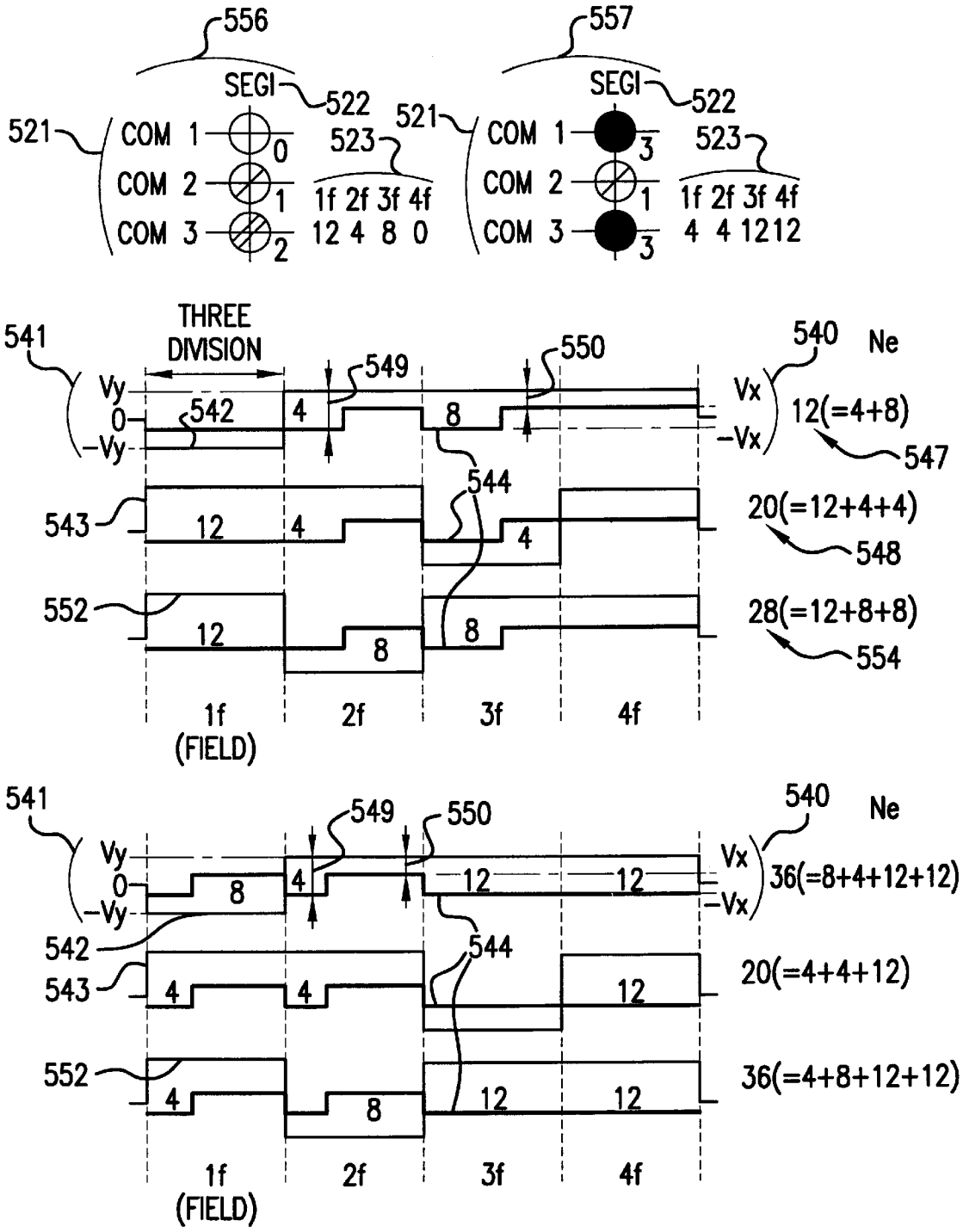
FIG. 13 is a view showing drive waveforms in the present embodiment when three lines are simultaneously selected.

FIG. 13 shows segment and common waveforms when three lines are simultaneously selected for displaying four gray shades according to the present embodiment. 512 denotes commons while 552 designates segments. 556 denotes a display pattern when the gray shades data of each pixel is 0, 1 or 2 while 557 designates a display pattern when the gray shades data of each pixel is 3, 1 or 3. 523 shows the result of the calculating formula for each field. 540 denotes segment voltage levels and 541 designates common voltage levels. Thin lines 542, 543 and 552 represent common waveforms and bold lines 544 depict segment waveforms.

In the present embodiment, the number of time divisions during the selected period is (N−1)=3. The results from the calculation of Ne which corresponds to the sum of the periods contributing to ON in the liquid crystal are shown in FIG. 13 on the right side of the respective waveforms. For example, as shown by 547, 548 and 554 in FIG. 13, Ne in the waveforms on the first, second and third rows may be 12, 20 and 28, respectively. In other words, the divisional units of 12, 20 and 28 in the waveforms of the first, second and third rows in which the gray shades are respectively 0, 1 and 2 will contribute to ON in the liquid crystal.

As will be apparent from FIG. 13, Ne is variable depending on the size of the gray shades data in each pixel. For example, Ne may be 36 for the gray shades 3 (black circle) whereas Ne is 12 for the gray shades 0 (white circle). For pixels having the same gray shades, Ne is always the same without dependent on the display pattern. For example, Ne for the gray shades 1 is always 20 even either of the display pattern shown by 556 or 557 in FIG. 13.

5. Virtual Data Generating Circuit

Figure 14:
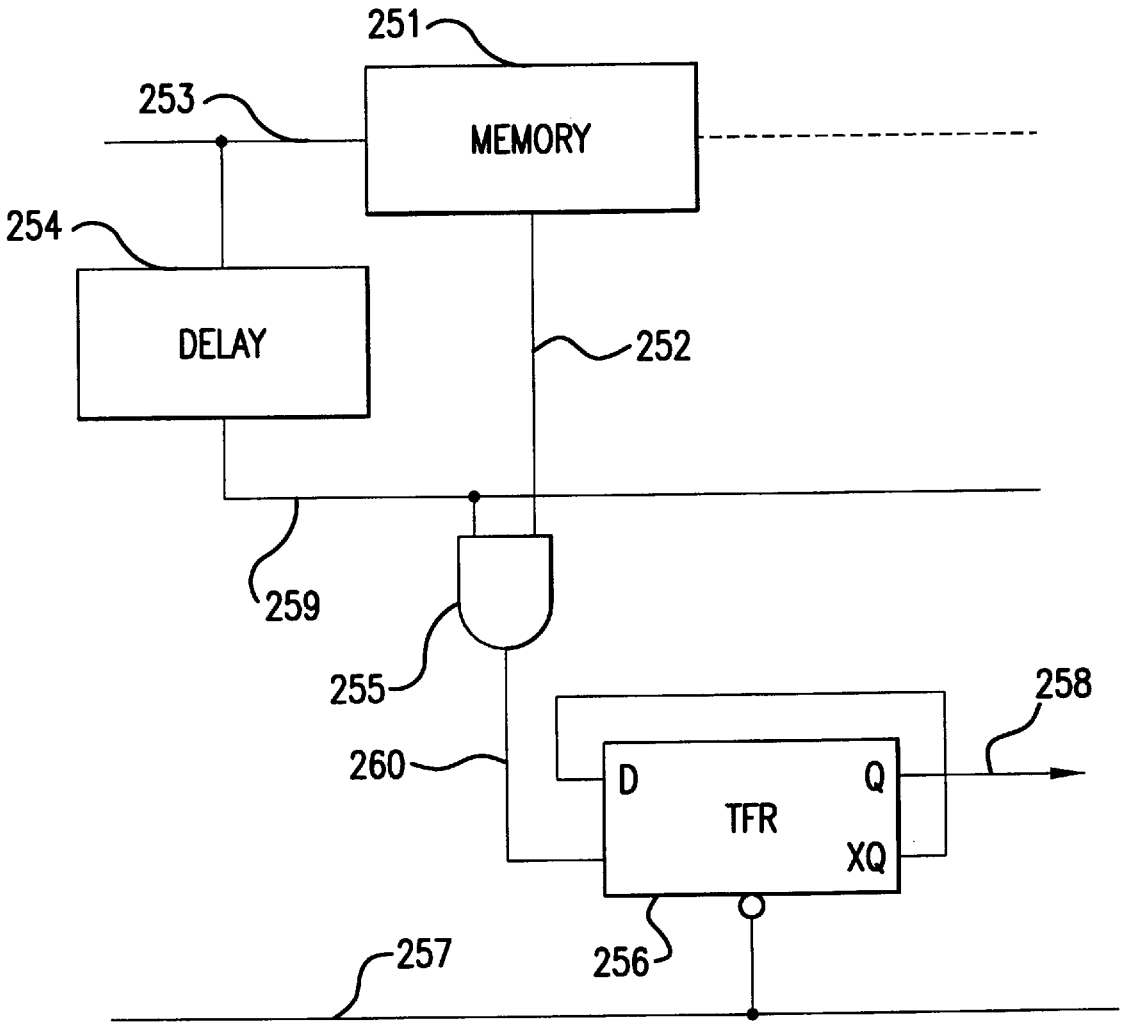
FIG. 14 is a view showing a virtual data generating circuit.
Figure 15:
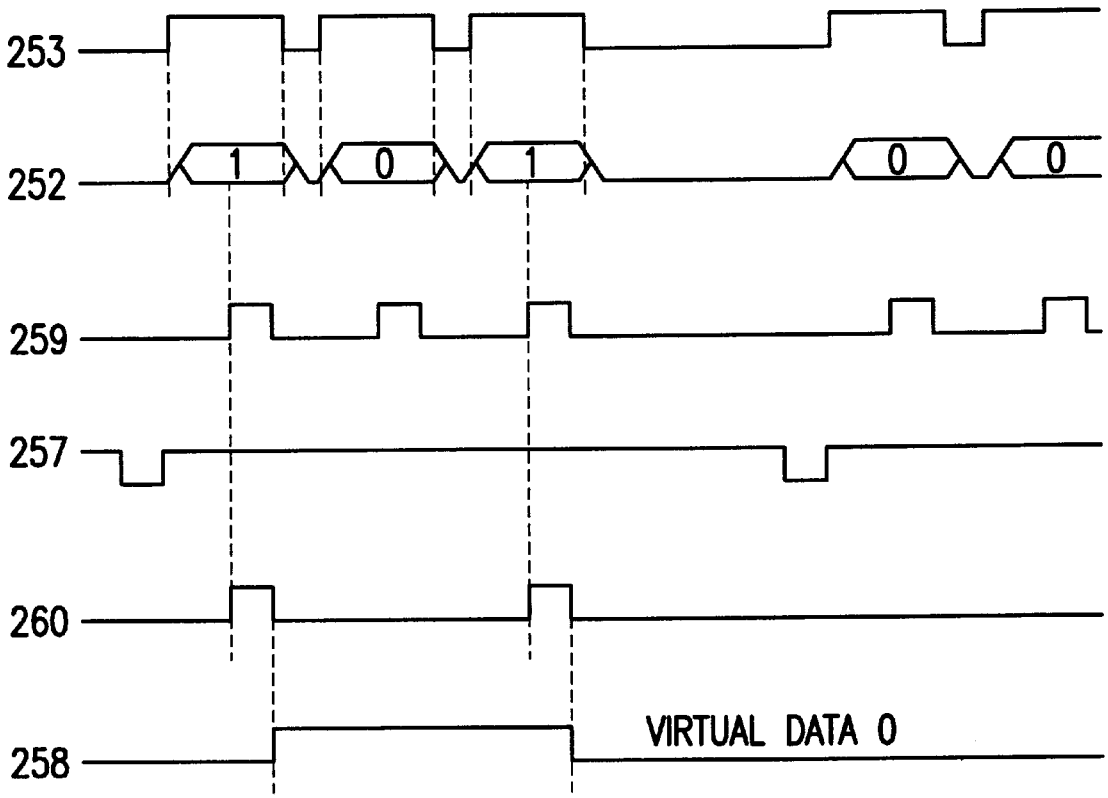
FIG. 15 is a timing diagram showing waveforms in the virtual data generating circuit.

FIG. 14 shows a block diagram of a virtual data generating circuit while FIG. 15 shows timing waveforms illustrating the calculation of the virtual data generating circuit. For simplification, FIG. 14 only shows the circuit layout corresponding to one bit. 251 is a memory or holding the gray shades data; 254 a delay circuit; 255 an AND circuit; and 256 a resettable toggle flip-flop (TFR). 253 denotes a memory read signal; 252 a memory output signal; 259 an output signal from the delay circuit; 257 a reset signal in TFR; 260 an output signal from the AND circuit; and 258 an output signal from the TFR 256 (virtual data).

The reset signal 257 is for initializing the TFR 256 and becomes active for each field. Thus, the TFR 256 can necessarily be initialized before the matrix calculation is started through the orthogonal function. The field means a time for which a segment voltage is once applied to the liquid crystal. In the method of 3MLS plus virtual data drive, the segment voltage is divided into four fields applied to the liquid crystal for realizing the gray shading.

In response to the memory read signal 253, three gray shades data are read out of the memory 251 for one field. The memory output signal 252 is outputted in synchronism with the memory read signal 253. The output signal 259 of the delay circuit 251 is a pulse signal outputted from the rising edge of the memory read signal 253 with a given delay. Such a delay can be realized by using an element delay or clock. The output signal 260 of the AND circuit 255 is generated by taking AND between the stable memory output signal 252 and the output signal 259 from the delay circuit 254. The output signal 260 of the AND circuit 255 becomes a pulse signal when the memory output signal 252 is 1 (High level) and is fixed to zero when the memory output signal 252 is 0 (Low level). Therefore, the output signal 258 of the TFR 256 is toggled when the memory output signal 252 is 1 and not toggled when the memory output signal 252 is 0. As a result, the output of the TFR 256 will be 1 if the memory output signal 252 becomes 1 one time or three times and will become 0 if the memory output signal 252 becomes H zero or two times. In other words, the output of the TFR 256 becomes 1 with the odd number of 1 in the memory output and 0 with the even number. Thus, the sum of the number of 1 in the output of the TFR 256 and the number of 1 in the memory 251 can be made even number. In such a manner, the output of the TFR 256 can be made a virtual data.

6. Simplification of Calculating Formula

A technique of simplifying the calculating formula of FIG. 9 by fixing L (simultaneously selected number plus the number of virtual data) and N (the number of gray shades) will now be described with reference to FIG. 16. The following description will be performed in connection with a case when L and N are fixed to 4 (simultaneously selected number equal to three and the number of virtual data equal to one) and 64 (the number of gray shades equal to 64), respectively.

In FIG. 16, D1, D2 and D3 represent the gray shades data on the first to third lines in a selected common respectively. K4 represents the virtual data. F1 to F4 denote line elements in the orthogonal function. For example, the first field may perform the calculation using the gray shades data −1, 1, 1 and 1 on the first line of the orthogonal function 223 shown in FIG. 10 as F1 to F4, respectively. The second field may use 1, 1, −1 and 1 on the second line; the third field may use 1, −1, 1 and 1 on the third line; the fourth field may use 1, 1, 1 and −1 on the fourth line.

The elements (F1 to F4) in the orthogonal function only take 1 or −1. Thus, the term of D1×F1+D2×F2+D3×F3+K4×F4 will provide a value resulting from addition or subtraction between the gray shades data. The term of (F1+F2+F3+F4) will be +2, 0 or −2 ) being not almost always 0). When (F1+F2+F3+F4) is +2, the term of −63×(F1+F2+F3+F4)+126 (a constant corresponding to the total sum of row elements in the orthogonal function) will be 0. Thus, the simplified calculating formula in this case becomes 2(D1×F1+D2×F2+D3×F3+K4×F4) as shown in FIG. 16. On the other hand, when (F1+F2+F3+F4) is −2, the term of −63×(F1+F2+F3+F4)+126 will be 252. Thus, the simplified calculating formula in this case will be 2{(D1×F1+D2×F2+D3×F3+K4×F4)+126}.

In such a manner, the simplified calculating formula is necessarily a multiple of 4. Therefore, PWM data can be provided by truncating data of two lower bits.

The case when L and N are respectively fixed to 4 and 64 has been described. However, the term of −63×(F1+F2+F3+F4)+126, which is a constant corresponding to the total sum of row elements in the orthogonal function (S=F1+F2+F3+F4), may more generally be represented by −(N−1)×S+(N−1)×L/2.

7. Segment Driver

Figure 17:
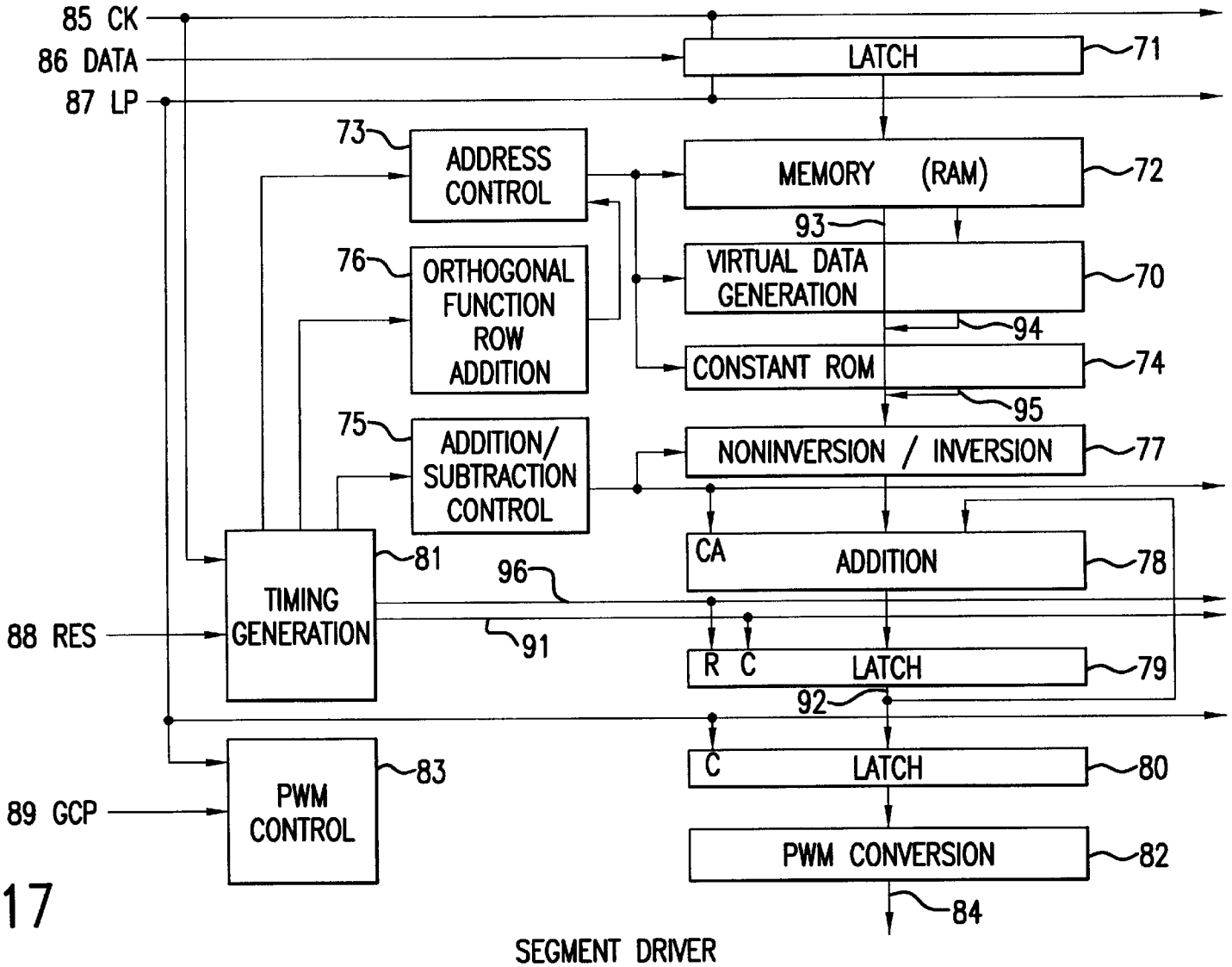
FIG. 17 is a block digram of the segment driver in the present embodiment.

FIG. 17 shows a block diagram of a segment driver which can realize an calculation according to the simplified calculating formula as shown in FIG. 16. This segment driver includes a memory for storing the gray shades data corresponding to six lines. For simplification, the block diagram only corresponds to one output bit.

A latch 71 functions as a date fetching circuit for writing the gray shades data into a memory 72 and also as a line latch. The latch 71 receives CKB5 used as a gray shades data fetching clock, DATA 86 being the gray shades data and LP 87 being a latch pulse. The memory 72 stores the gray shades data corresponding to six lines. A virtual lines generating circuit 70 generates a virtual data based on the gray shades data and may be in such a form as shown in FIG. 14. An address controls circuit 73 controls addresses of the memory 721 the virtual data generating circuit 70 and a constant ROM 74 which is a ROM for storing constants 0 and 126.

An addition-subtraction control circuit 75 controls the selection relating to whether the addition of subtraction should be done and outputs 1 or 0 depending on the inputted orthogonal function. In this example, the addition-subtraction control circuit 75 outputs 1 when the element of the orthogonal function is −1 and 0 when the element is 1. An orthogonal function row adding circuit 76 outputs (F1+F2+F3+F4) which is the result of calculation relating to F1 to F4 in the orthogonal function. The orthogonal function row adding circuit 76 outputs 1 when the result of calculation is 2, and outputs 0 when the result of calculation is −2. Usually, the addition-subtraction control circuit 75 and orthogonal function row adding circuit 76 may be formed by decoders since the respective elements of the orthogonal function have fixed values.

A non-inverting/inverting circuit 77 inverts or non-inverts an input signal and inverts an input signal when the output of the addition-subtraction control circuit 75 is 1 (when the element of the orthogonal function is −1). An addition circuit 78 adds 8 bits, receives an output from the non-inverting/inverting circuit 77 and 8-bit latch 79 (which is formed of a resettable flip-flop). The result of the addition is outputted to the latch 79. The latch 79 receives a reset signal 96 and clock 91 from a timing generating circuit 81. The timing generating circuit 81 is responsive to CK85, LP87 and RES88 (which is an initializing signal) for generating various timing signals which are in turn outputted therefrom toward blocks 73, 76, 75 and so on. Another latch 80 holds the final result of calculation and is controlled by LP81.

PWM conversion circuit 82 performs PWM conversion based on the results of calculation held by the latch 80. The PWM conversion circuit 82 will not further be described since it can be formed by any existing PWM driver. The PWM control circuit 83 controls the PWM conversion circuit 82 and receives GCP89 that is a pulse width division clock.

Figure 18:
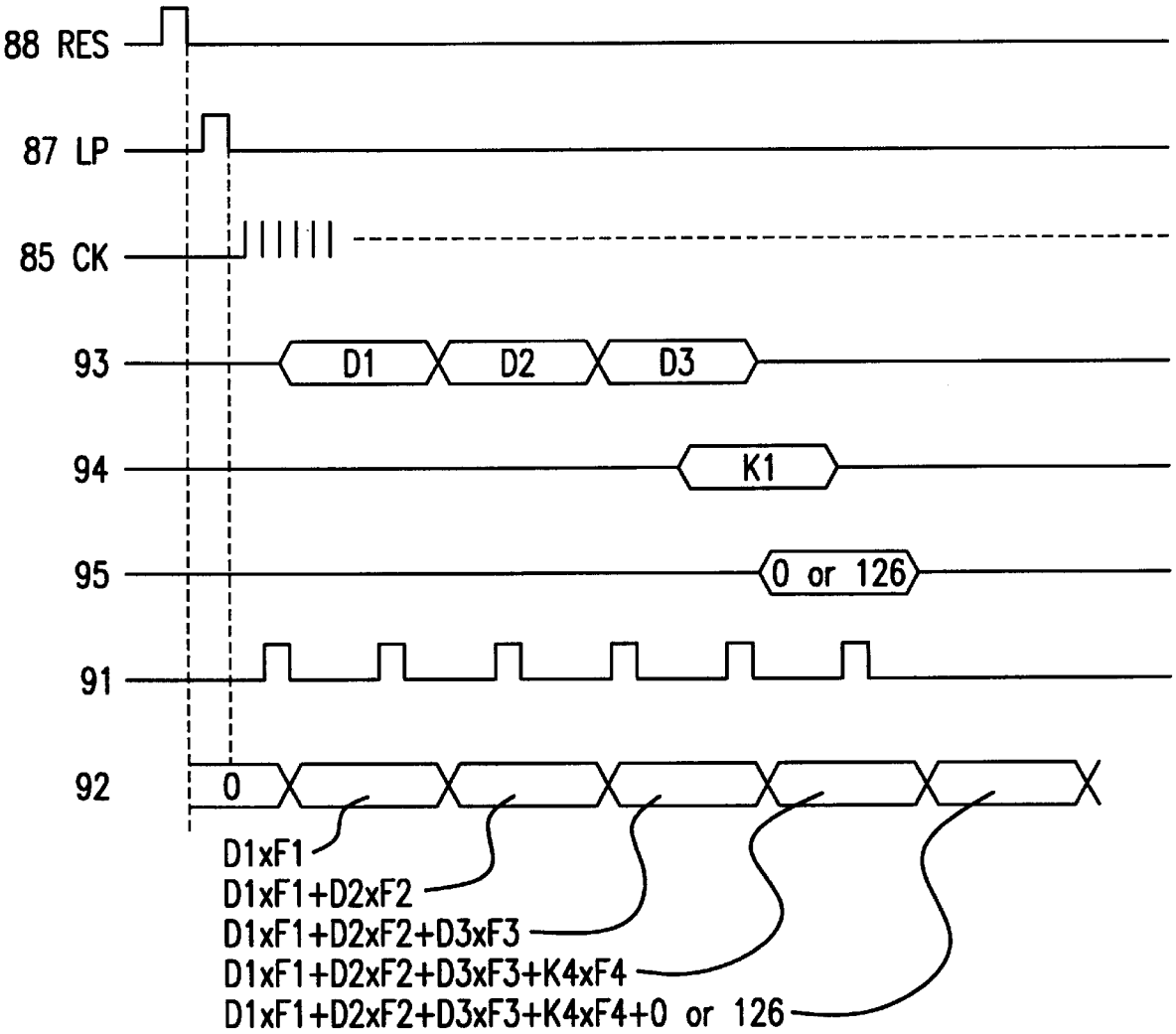
FIG. 18 is a timing diagram showing waveforms in the segment driver.

FIG. 18 shows timing waveforms for illustrating the calculation of the segment driver shown in FIG. 17. RES88 has been made active before data in the display screen on the first row is inputted. LP87 is made active for each horizontal period (1H). Although FIG. 18 shows LP87 made active immediately after RS88 has been made active, LP87 may be made active after all the data on the first row have been received. CK85 is a clock used to fetch the gray shades data, but its waveform is not shown for simplification. Usually, segment drivers are operatively connected together through an enable chain for reducing the power consumption. Thus, CK85 is activated only during a period through which each of the segment drivers is inputting the data, but fixed to a given level during the other period. A circuit for realizing the enable chain is omitted from FIG. 17 since it can be accomplished by any one of the existing techniques.

In FIG. 18, 93 is an output signal from the memory 72; 94 an output signal from the virtual data generating circuit 70; and 95 an output signal from the constant ROM 74. CK85 is inputted into the latch 71 for fetching data corresponding to three lines to be subsequently displayed in the memory which corresponds to the remaining three lines. A clock 92 from the timing generating circuit 81 is generated by dividing this CK85. The clock 91 is then inputted into the clock terminal of the latch 79 shown in FIG. 17. 92 denotes an output signal from the latch 79.

The process of generating the output signal 92 that is the results of calculation will be described. First of all, the reset signal 96 inputted into the latch 79 of FIG. 71 is made active in synchronism with RES88 or LP87 to clear the contents stored in the latch 79. Thus, the output signal 92 becomes zero. The memory 72 then outputs the data D1 on the first row under control of the address control circuit 73 which is activated by a timing signal from the timing generating circuit 81. At the same time, the addition-subtraction control circuit 75 activated by the timing signal from the timing generating circuit 81 determines whether the first calculation is addition or subtraction. If the first calculation is subtraction, the addition-subtraction control circuit 75 causes the non-inverting/inverting circuit 77 to invert the output of the memory 72 and also outputs 1 toward the carry input CA of the addition circuit 78. Thus, the data is converted into a complement of 1. The addition circuit 78 performs the addition based on the output (0) of the latch 79 and the output of the non-inverting/inverting circuit 77 and in response to the state of the carry input CA, with the result thereof being held in the latch 79. As shown in FIG. 18, thus, the latch 79 will output D1×F1(D1 or −D1) at the first falling edge timing of the clock 91.

Under control of the address control circuit 73, the memory 72 then outputs the data D2 on the second row. Subsequently, the similar procedure described above is performed and the latch 79 outputs D1×F1+D2×F2 at the second falling edge timing of the clock 91. Similarly, the latch 79 outputs D1×F1+D2×F2+D3×F3 at the third falling edge timing of the clock 91.

At the fourth falling edge timing of the clock 91, the virtual data K4 from the virtual data generating circuit 70 is used rather than the data from the memory 72. Thus, the latch 79 outputs D1×F1+D2×F2+D3×F3+K4×F4.

Under control the address control circuit 73, then, the constant ROM 74 outputs 0 or 126. Whether 0 or 126 should be outputted is determined by the address control circuit 73 in response to the output from the orthogonal function row adding circuit 76. More particularly, the constant ROM 74 outputs 0 when F1+F2+F3+F4=2 and outputs 126 when F1+F2+F3+F4=−2 (see FIG. 16). The output of the constant ROM 74 is inputted into the addition circuit 78 through the non-inverting/inverting circuit 77 without being inverted by the non-inverting/inverting circuit 77. Therefore, the latch 79 outputs D1×F1+D2×F2+D3×F3+K4×F4+0 or D1×F1+D2×F2+D3×F3+K4×F4+126 at the fifth falling edge timing of the clock 92.

If the output of the latch 79 is carried by one bit, such a value 2×(D1×F1+D2×F2+D3×F3+K4×F4+0 or D1×F1+D2×F2+D3×F3+K4×F4+126) as shown in FIG. 16 can be provided. However, the final results of calculation in the calculating formula of FIG. 16 is necessarily a multiple of 4 as described and the two lower bits become 0 in the final results of calculation. Thus, it is not required that the output of the latch 79 is raised. Rather, the output of the latch 79 is shifted down (or cancels one lower bit). The data is held in the latch 80 in response to LP87. The PWM conversion circuit 82 performs the pulse width modulation in accordance with the data from the latch 80.

In such a manner, the pulse width modulation can be performed according to the calculating formula of FIG. 16.

8. Display Controller

Figures 19, 19A:
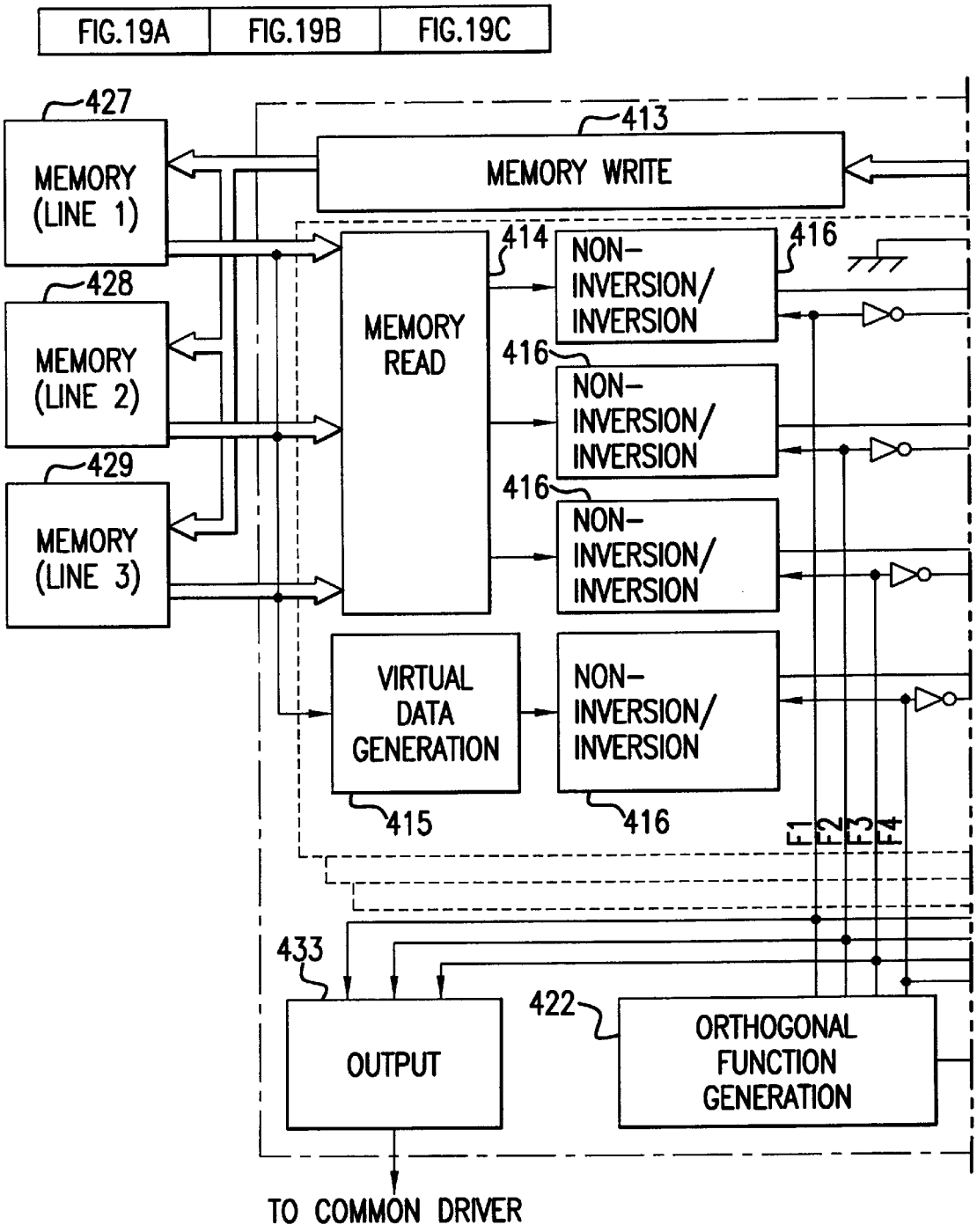
FIGS. 19A–19C are block diagrams the display controller in the present embodiment.
Figure 19B:
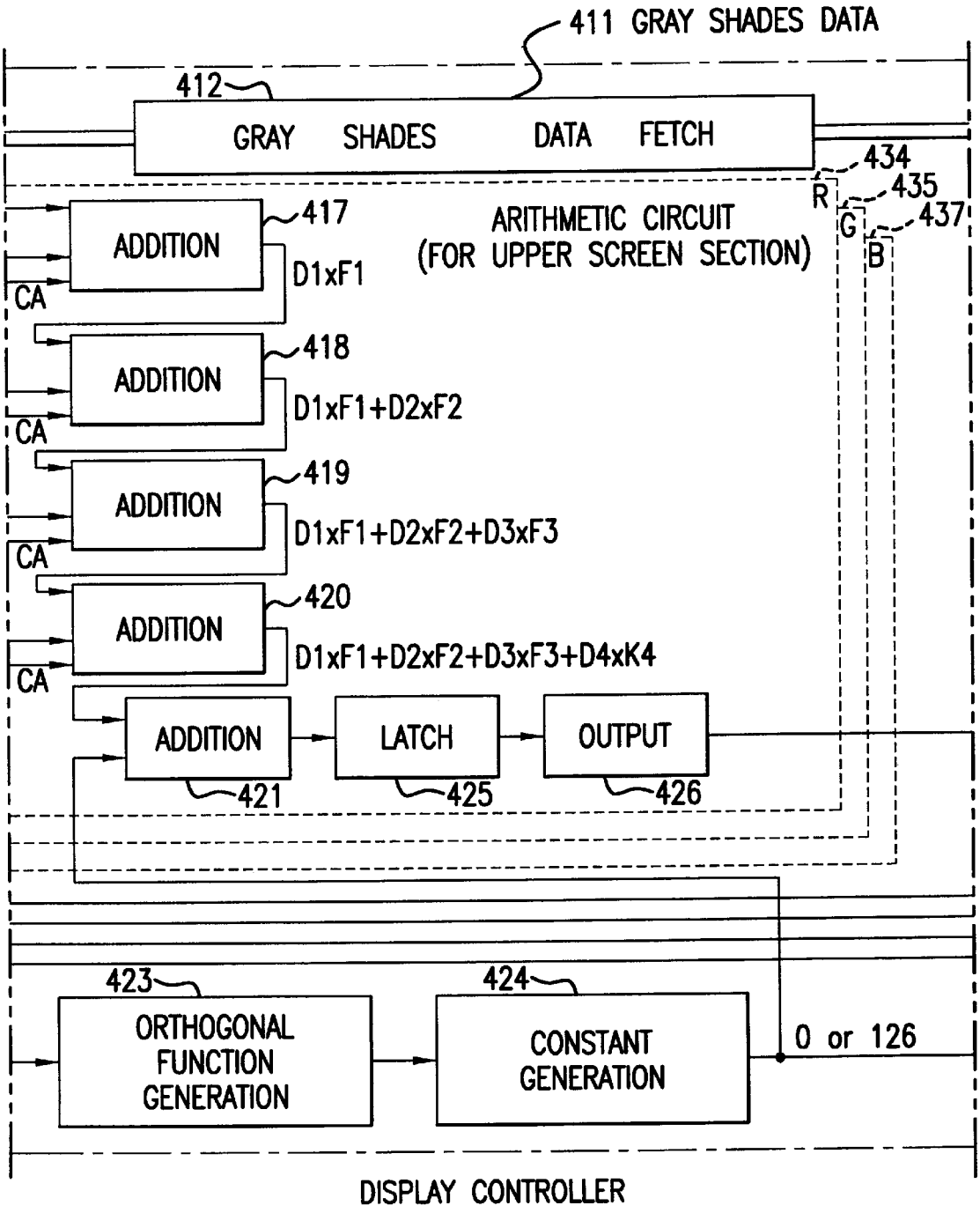
Figure 19C:
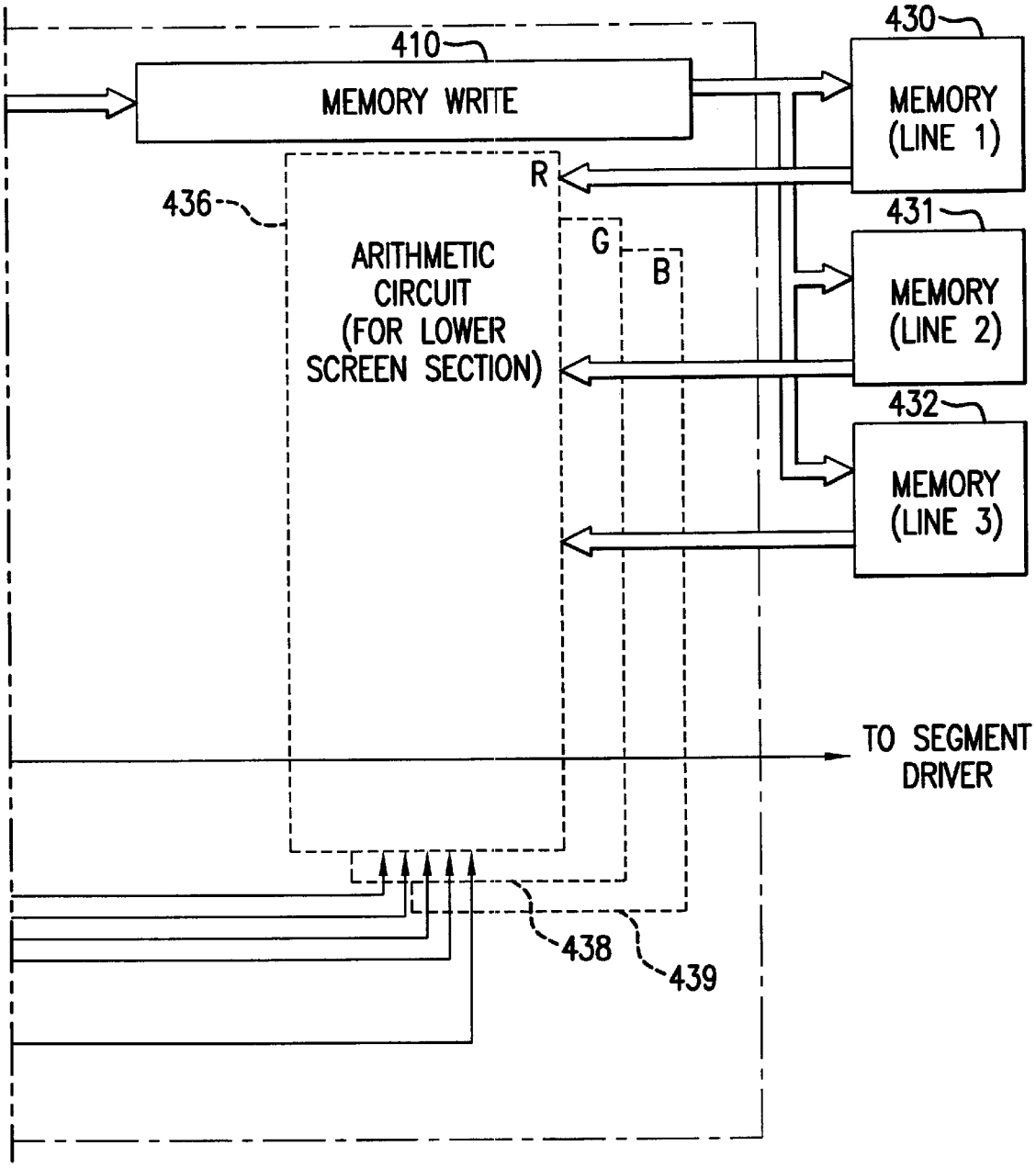

FIG. 19 shows a block diagram of a display controller which can realize an calculation in accordance with the simplified calculating formula or FIG. 16. Outside this display controller are provided memories 427 to 432 which hold the gray shades data corresponding to six or more lines. The display controller reads data corresponding to three lines among the data stored in the memory to convert them into PWM data. At the same time, the display controller writes the gray shades data from the conventional display controller which has been developed for TFT drive or the like (see FIG. 24) in the storage area corresponding to the remaining three lines in the memory.

Figure 20:
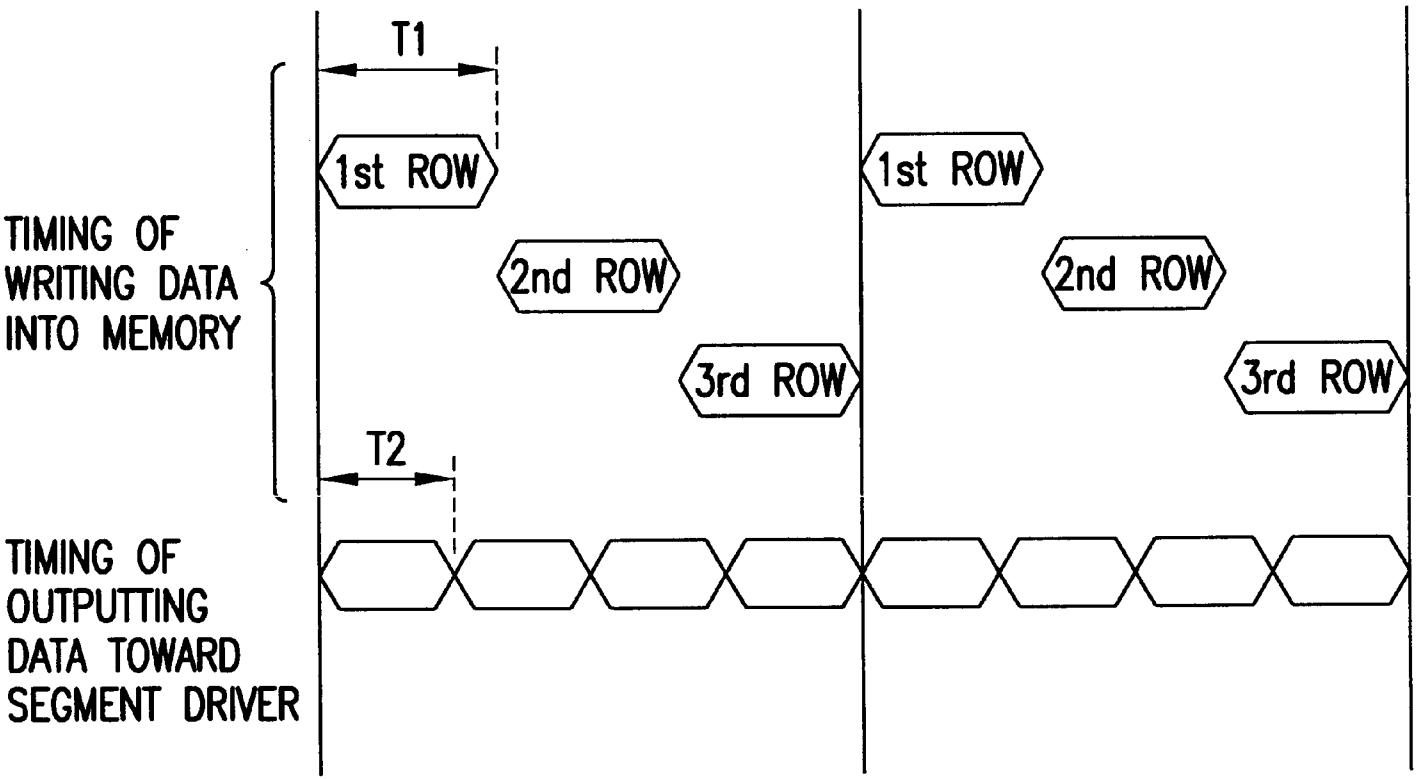
FIG. 20 illustrates a relationship between the write timing to the memory and the data output timing to the segment driver.

In the driving method according to the present embodiment, it is required that data corresponding to four lines are outputted to the segment driver for displaying three lines. For such a purpose, in the present embodiment, PWM data is outputted toward the segment driver in a cycle which is obtained by dividing a write cycle of the gray shades data for three lines into four equal periods. More particularly, as shown in FIG. 20, such a form that $T2=(LM/L)\times T1=(3/4)\times T1$ can be satisfied is provided where T1 is a cycle time for written data into the memory; T2 is a cycle time for outputting data toward the segment driver; LM is the number of simultaneously selected lines; and L is the sum of LM and the number of virtual data. Thus, the 3MLS driver can be realized using the virtual data.

More generally, T2 will be equal to $m\times(LM/L)\times T1$ (m being a positive integer). For example, when data for higher and lower screen sections are to be separately generated and outputted as will be described later, T2 will be equal to $2\times(LM/L)\times T1$.

With 64 gray shades, the gray shades data will be 18 bits with 6 bits×RGB. However, the memory can usually handle only 16-bit data. Therefore, the display controller converts the respective one of 6-bit R, G and B data into data of 5, 6 and 5 bits so that the data written into the memory will be 16 bits.

As shown in FIG. 19, six memories 427 to 432 are provided outside. The memories 427 to 429 are used for the half-upper screen while the memories 430 to 432 are used for the half-lower screen. The respective pair of memories (427 and 430; 428 and 431; 429 and 432) is used as a memory for line 1, line 2 or line 3. The display controller according to the present embodiment writes the gray shades data from the conventional display controller into the respective memories. At the same time, the display controller performs the conversion of the respective 6-bit R, G and B data into 5-bit, 6-bit and 5-bit data, respectively. The display controller simultaneously fetches the gray shades data corresponding to three dots (or the gray shades data on the same column corresponding to three simultaneously selected lines) from the respective memories when the gray shades data are read in from the memories. Instantaneously, the display controller produces the virtual data, generates PWM data through a batch calculation and outputs them toward the external segment driver.

In FIG. 19, 411 is a gray shades data; 412 a gray shades data fetching circuit; 413 and 410 memory writing circuits; 414 a memory reading circuit; 415 a virtual data generating circuit which is formed by a gate circuit for generating 1 when the gray shades data of each bit has its binary representation (100), (010), (001) or (111); 416 a non-inverting/inverting circuits; 433 an output circuit for outputting the orthogonal function toward the outside; 422 an orthogonal function generating circuit; 423 a orthogonal function row adding circuit for performing the addition of F1+F2+F3+F4; 424 a constant generating circuit; 425 a latch; and 426 an output circuit for outputting PWM data toward the external segment driver.

There are also provided external memories 427, 428, 429, 430, 431 and 432. These memories are in the form of a two-port memory which can perform the writing operation to another address during the reading procedure. Address lines, data lines, red lines and write lines in the memories are omitted for simplification. The memories 427 and 430 hold the gray shades data on the first line among the simultaneously selected lines; the memories 428 and 431 hold the gray shades data on the second line; and the memories 429 and 432 hold the gray shades data on the third line.

To process the R, G and B data in a batch manner and to generate and output the data for the upper and lower screen sections, the display controller includes six arithmetic circuits 434, 435, 437, 436, 438 and 439. Among them, each of the arithmetic circuits 434, 435 and 437 is used for the upper screen section and for R, G and B respectively while each of the arithmetic circuits 436, 438 and 439 is used for the lower screen section and for R, G and B respectively.

The operation of the display controller will now be described. The gray shades data fetching circuit 412 is designed to fetch the gray shades data 411 and at the same time to convert 18-bit data into 16-bit data. In other words, the lower order bits of R and B are cancelled. The memory writing circuits 413 and 410 then write the gray shades data into the memories. At this time, the gray shades data are reading circuit 414 reads the gray shades data for lines 1, 2 and 3 in a basic manner. The virtual data generating circuit 415 generates the virtual data based on the gray shades data. The orthogonal function generating circuit 422 generates F1 to F4. The non-inverting/inverting circuit 416 will non-invert the input data if F1 to F4 are 1 and invert the input data if F1 to F4 is −1. The addition circuits 417 to 421 include their own carry input CA into which 0 is inputted if F1 to F4 are 1 and into which 1 is inputted if F1 to F4 are −1. Thus, the non-inverting/inverting circuit 416 and the carry inputs CA of the addition circuits 417 to 420 will be controlled based on F1 to F4 to control whether the addition circuits 417 to 420 should be caused to perform addition or subtraction.

The addition circuit 417 outputs D1×F1. The addition circuit 418 adds the output D1×F1 to D2×F2 to output D1×F1+D2×F2. Similarly, the addition circuit 419 outputs D1×F1+D2×F2+D3×F3 and the addition circuit 420 outputs D1×F1+D2×F2+D3×F3+K4×F4. The addition circuit 421 performs the addition between the output of the addition circuit 420 and the output of the constant generating circuit 424 (0 or 126). Thus, the output of the addition circuit 421 will be D1×F1+D2×F2+D3×F3+K4×F4+0 or D1×F1+D2×F2+D3×F3+K4×F4+126. The latch 425 latches the output of the addition circuit 421. If the output of the addition circuit 421 is carried by one bit, there can be provided 2×(D1×F1+D2×F2+D3×F3+K4×F4+0 or +126). However, the final results of calculation from the result of calculation of FIG. 16 is necessarily a multiple of 4 as described. The two lower bits in the final results of calculation becomes 0. Thus, it is not required that the output of the addition circuit 421 is carried. Rather, the output of the addition circuit 421 is shifted down (or the one lower bit being cancelled) and stored in the latch 425. The output circuit 426 then outputs 6-bit PWM data toward the external segment driver.

If the frame frequency is 60 Hz in a liquid crystal display panel of XGA class (1024×768 dots), the fetching frequency of the gray shades data will be in the order of 1024×768×60=47.2 MHz (RGB parallel). Therefore, a cycle time required to write the data into the external memory is about 20 ns. Since the display controller of FIG. 19 separately generates and outputs data for the upper and lower screen sections, it may only be required that the data is read out at a cycle time of 40 ns. However, the data will eventually be read out at a cycle time of 40 ns×3/4=30 ns since the data must be outputted four times during the three-line process. In any event, the display controller of FIG. 19 requires a high-speed memory.

Figure 21:
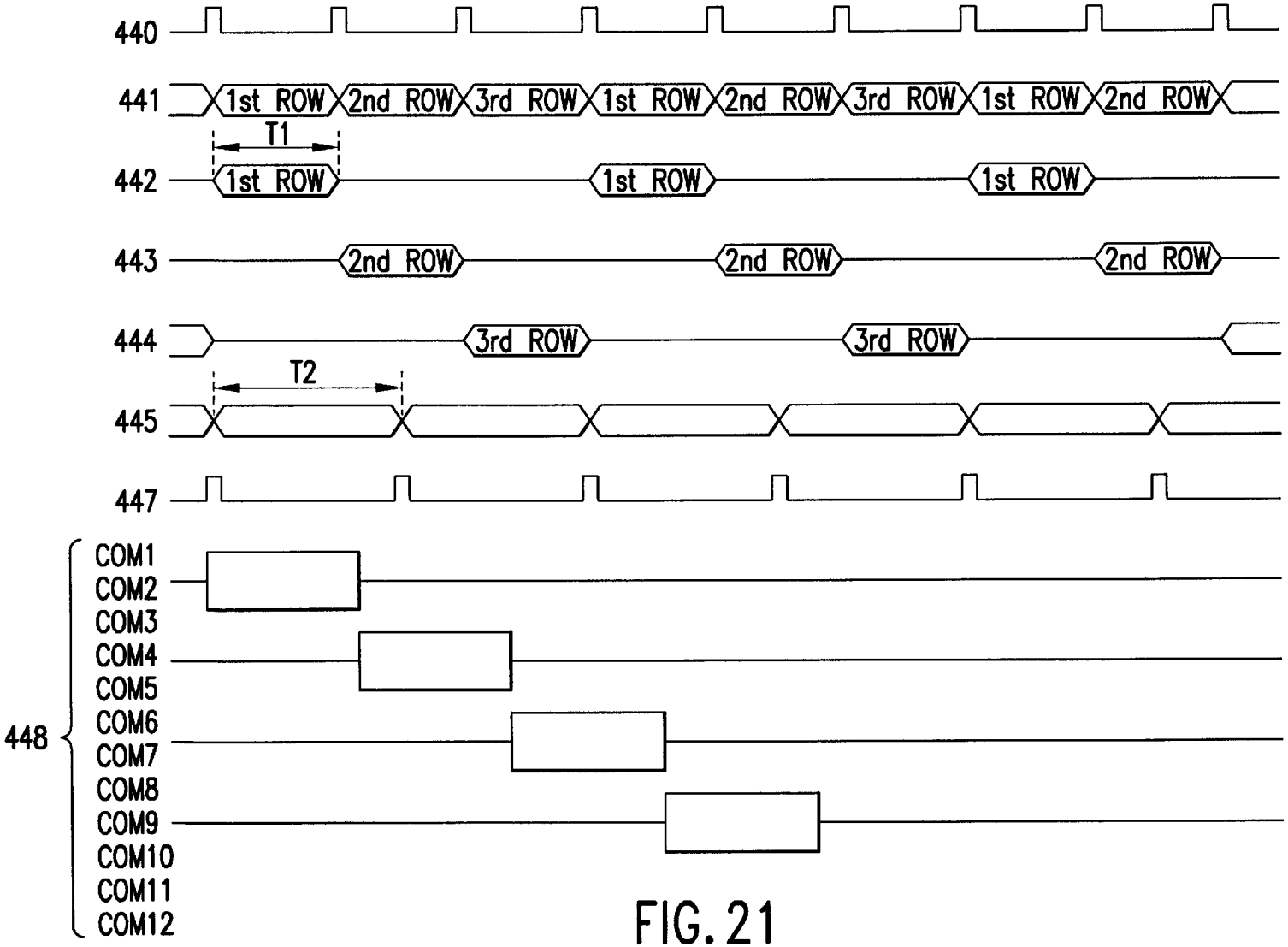
FIG. 21 is a diagram showing waveforms of signals in the display controller.

FIG. 21 shows timing waveforms for illustrating a timing for fetching the gray shades data, a timing at which the data is outputted to the segment driver and a timing for scanning the common driver. 440 denotes a horizontal synchronous signal for fetching the gray shades data corresponding to one line and 441 designates the gray shades data to be inputted. 442, 443 and 444 denote timings for writing to the memories; 445 a timing for outputting the data to the external segment driver; 447 a timing for scanning the common driver; and 448 a timing for outputting the data toward the common driver.

The gray shades data 441 is written into the memory corresponding to each of the lines at such timings as shown by 442, 443 and 444. Data corresponding to one line is outputted toward the segment driver for a time obtained by quadrisecting the time required to write the gray shades data corresponding to six lines. In the display controller of FIG. 19, the generation and output of PWM data to be supplied to the upper screen segment driver (see G1 of FIG. 23) are performed by the arithmetic circuits 434, 435 and 437 while the generation and output of PWM data to be supplied to the lower screen segment driver (see G2 of FIG. 23) are performed by the arithmetic circuits 436, 438 and 439. In FIG. 21, therefore, $T2=2\times(LM/L)\times T1=6/4\times T1$ when T1 is a cycle time required to write the data into the memory and T2 is a cycle time required to output the data toward the segment driver.

The level in the output signal 448 of the common driver is determined by the orthogonal functions F1, F2 and F3. The level of the output signal 448 of the common driver will be a central voltage about the output of the segment driver during the period other than the selected period. When the display is OFF, the output of the segment driver also becomes a voltage in the non-selected level. F1, F2 and F3 to be inputted into the common driver are outputted by the output circuit 433 included in the display controller of FIG. 19. However, the output circuit 433 outputs a value used in the calculation of one previous field, rather than the output being now calculated. This can be realized by inputting F1, F2 and F3 from the orthogonal function generating circuit 422 into the data terminal of the flip-flop included in the output circuit 433, flip-flop and (transmitting the output of the flip-flop to the common driver.

9. Common Driver

Figure 22:
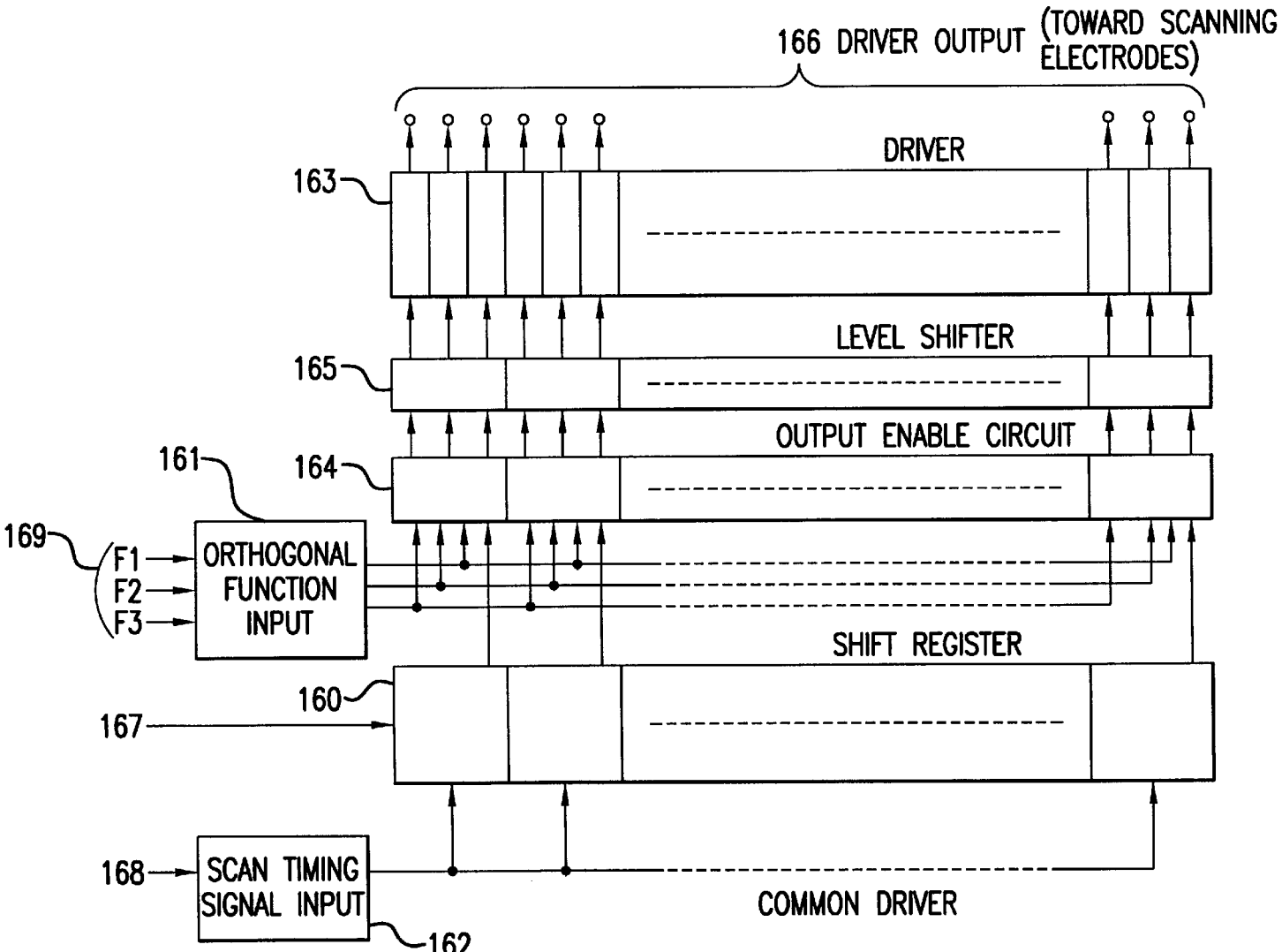
FIG. 22 is a block diagram of the common driver in the present embodiment.

FIG. 22 shows a block diagram of a common driver according to the present embodiment. 161 denotes an orthogonal function input circuit; and 162 a scan timing signal input circuit. 160 is a shift register; 164 an output enable circuit; 165 a level shifter; 163 a driver; and 166 driver outputs. 169 designates orthogonal function signals F1 to F3; 167 a start signal; and 168 a scan timing signal.

The shift register 160 is formed by a plurality of flip-flops, each of which corresponds to three driver outputs 166. As the start signal 167 is inputted into the shift register 160, the latter initiates the shift of data based on the scan timing signal. The output enable circuit 164 is responsive to the output of the shift register 160 to determine whether or not the voltage levels corresponding to the values F1, F2 and F3 should be outputted toward the driver 163. If the output of the shift register 160 is 0, the driver outputs 166 are in the intermediate voltage. If the output is 1, the driver outputs 166 are in voltages levels corresponding to the values F1, F2 and F3. In other words, the driver outputs 166 become voltage levels corresponding to F1, F2 and F3 for every three lines. The orthogonal function signals 169 (F1, F2 and F3), start signal 167, scan timing signal 168 and the like are inputted from the display controller.

10. Liquid Crystal Display Device

Figure 23:
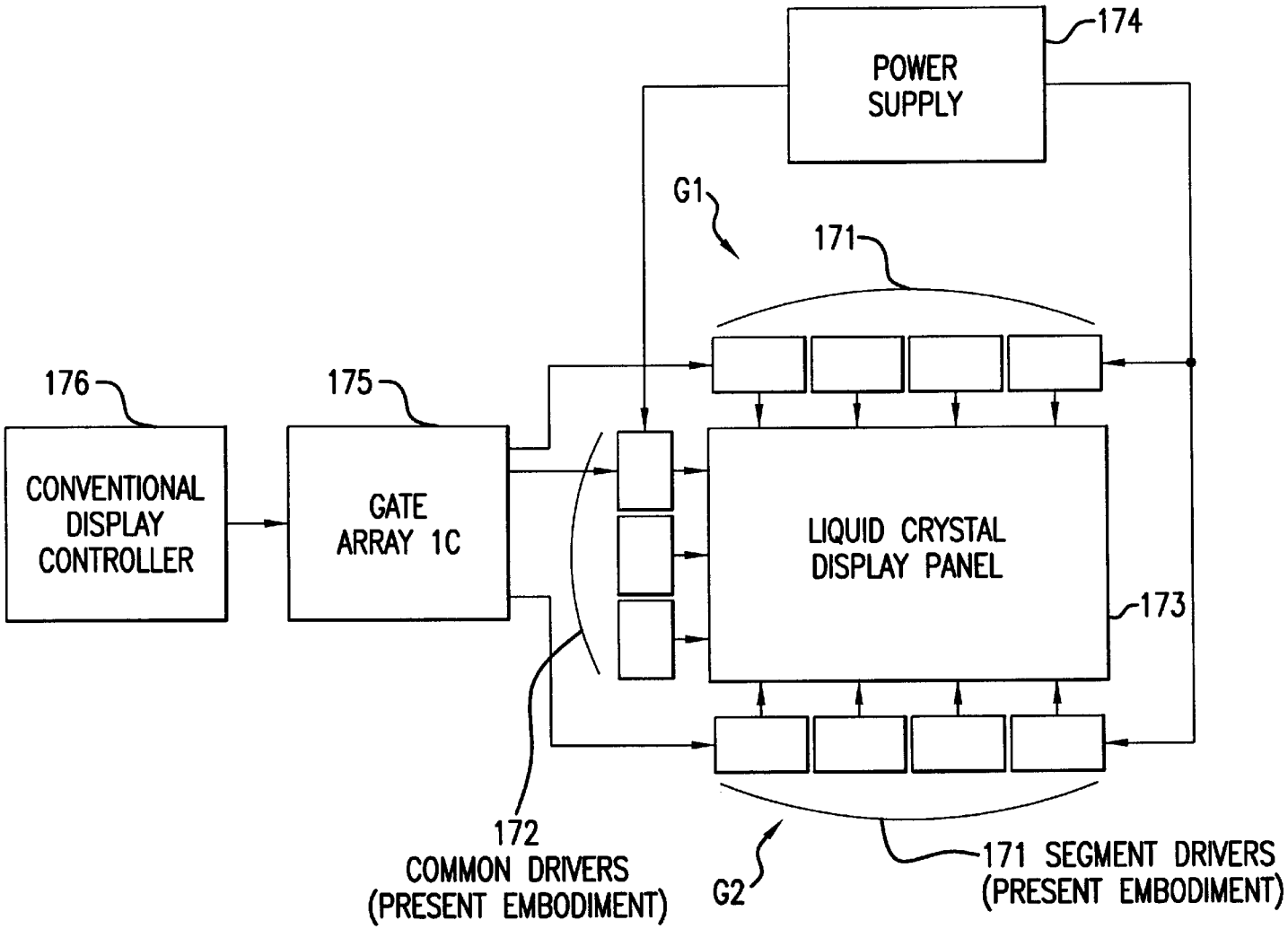
FIG. 23 is a block diagram of a liquid crystal drive using the segment and common drivers according to the present embodiment.

FIG. 23 shows a block diagram of a liquid crystal display device which comprises the segment drivers as shown in FIG. 17 and the common drivers as shown in FIG. 22. The segment drivers 171 are disposed above and below a liquid crystal display panel 173. The common drivers 172 are arranged on the left side of the liquid crystal display panel 173. The segment and common drivers 171, 172 are mounted in a tape carrier package (TCP) and adhesively applied to the liquid crystal display panel 173. 174 is a power supply circuit; 175 a gate array IC for generating timing signals; and 176 a conventional display controller. The gate array IC 175 outputs a timing signal (which is caused to generate a scan timing signal having the frequency 4/3 times the input timing of the gray shades data) of the segment drivers 171, a clock for generating a gray shades pulse, a timing signal for scanning the common drivers, a start signal, F1, F2 and F3 signals and so on. The details of the gate array IC are omitted herein.

According to the present embodiment, it is possible that 18-bit data for IFT liquid crystal display panel is inputted directly into the segment drivers 171 as an output from the conventional display controller 176. In this case, therefore, the display controller of FIG. 19 and any external memory are not required.

Figure 24:
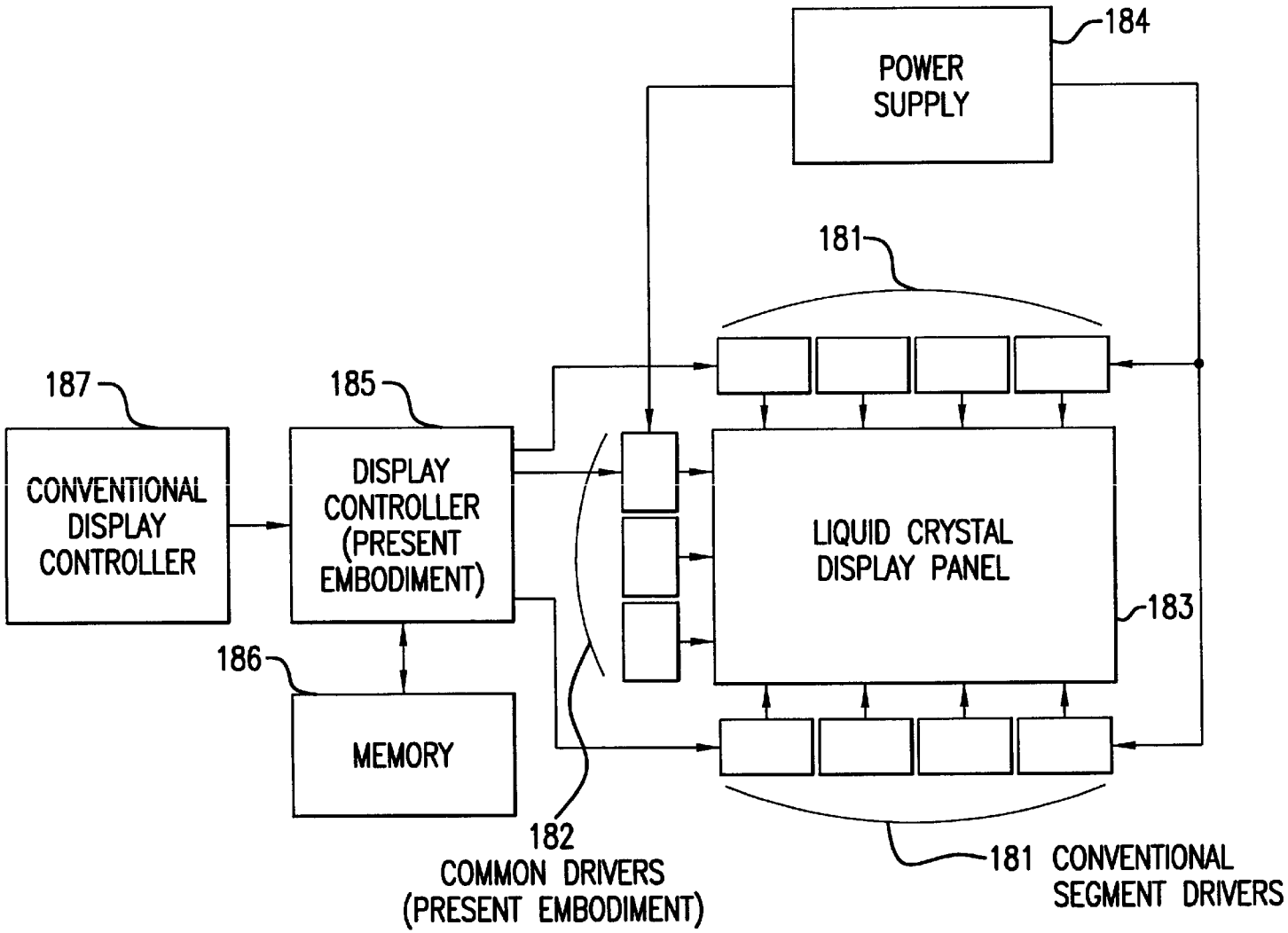
FIG. 24 is a block diagram of a liquid crystal drive using the display controller and common driver according to the present embodiment.

FIG. 24 shows a block diagram of a liquid crystal display device which comprises the display controller of FIG. 19, the common drivers of FIG. 22 and a conventional segment drivers. 181 is conventional PWM convertible segment drivers. The segment drivers 181 are disposed above and below a liquid crystal display panel 183. The common drivers 182 are arranged on the left side of the liquid crystal display panel 183. The segment driver 181 and common driver 182 are mounted on TCP and adhesively applied to the liquid crystal display panel 183. 184 is a power supply circuit; 185 the display controller of FIG. 19; 186 a memory for storing the gray shades data; and 187 the conventional display controller.

Figure 25A:
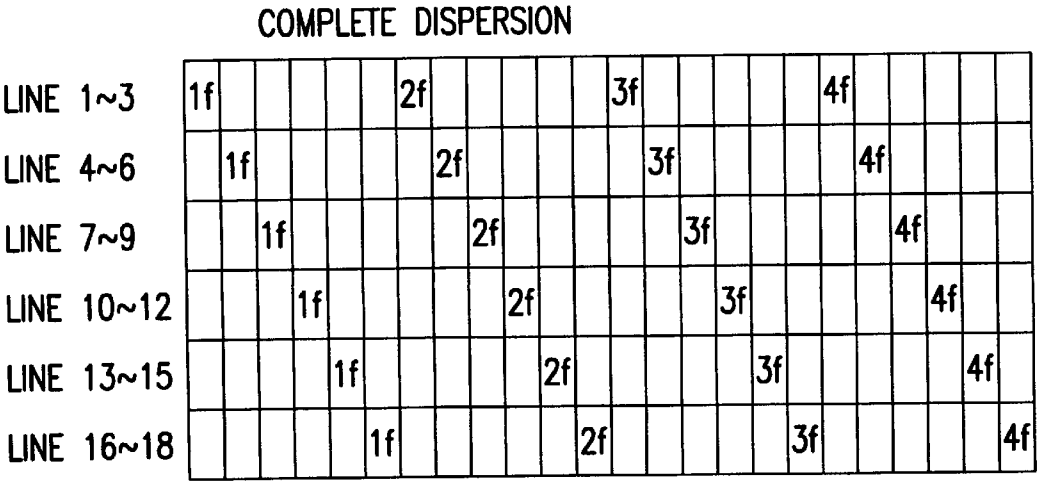
FIGS. 25A and 25B are schematic views of the complete and half dispersion drives.
Figure 25B:
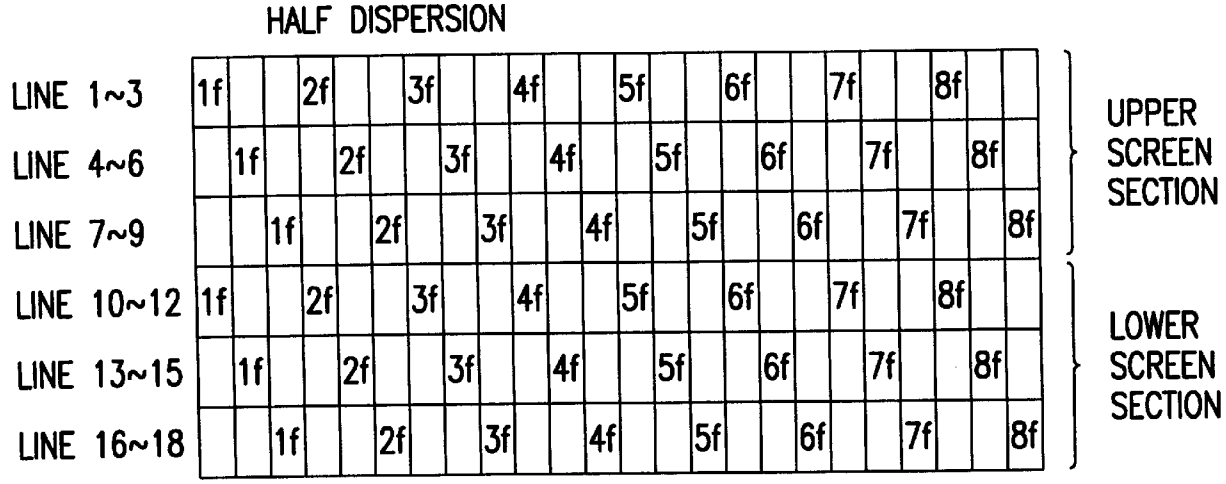

The liquid crystal display device of FIG. 23 has its circuit scale larger than that of the liquid crystal display device of FIG. 24 because the segment drivers 171 of FIG. 23 must include their own memories. When the MLS driver is carried out with such a complete dispersion as shown in FIG. 25A or such a half-dispersion as shown in FIG. 25B, the segment drivers 171 must include memories for storing data corresponding to one complete screen or one-half screen. When it is now assumed that the outputs of the segment drivers are equal in number to 240 and that the complete dispersion driver of 64 gray shades (6 bits) is performed on a screen having its XGA size (1024×768 dots), each of the segment drivers requires to include a memory of 1.1 M bits (240×6×768). In the modern process technique, the chip size of a segment driver will be increased and expensive when such a memory is mounted with that segment driver. Also when the liquid crystal display device uses the total number of segment drivers equal to 26 in which each group of 13 segment drivers are disposed above and below the liquid crystal display panel, it is unreal in cost. When an increased memory capacity is required by the MLS driver through the complete or half-dispersion, therefore, the system of FIG. 24 is more advantageous than that of FIG. 23.

Figure 26A:
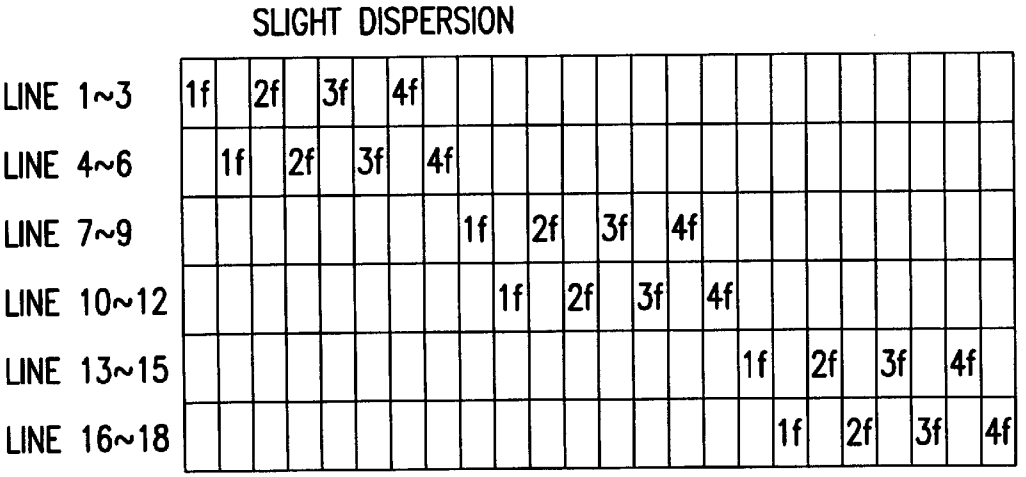
FIGS. 26A and 26B are schematic views of the slight and non-dispersion drives.
Figure 26B:
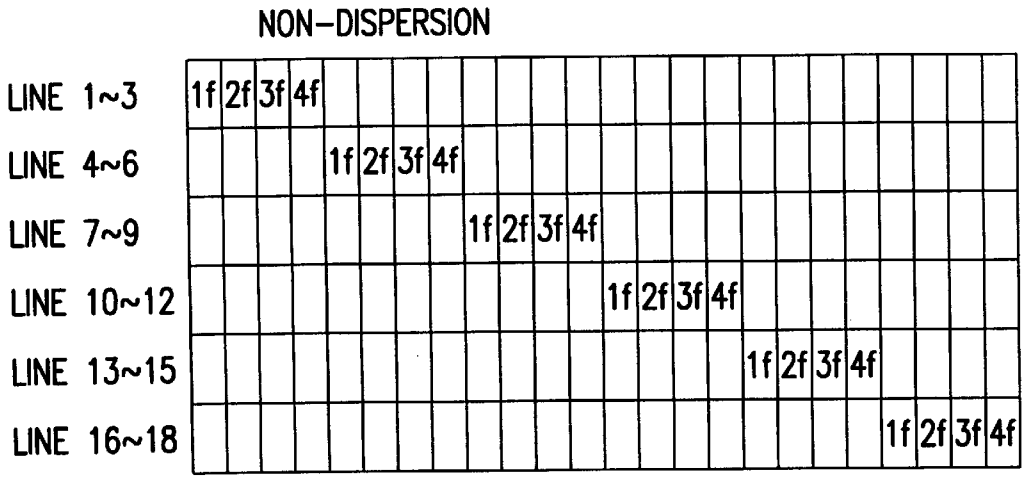

As schematically shown in FIG. 25A, the complete dispersion driver performs the drive with the data of the first to fourth fields (1*f* to 4*f*) within one frame. For example, the complete dispersion drive process drives one screen from its top to bottom with the data of the first field, then drives the same screen from its top to bottom with the data of the second field. This is continued until the fourth field. As schematically shown in FIG. 25B, the half-dispersion drive process performs the complete dispersion drive at the respective one of the upper and lower screen sections. As schematically shown in FIG. 26A, the slight dispersion drive process alternately drives upper and lower three lines among six lines. As schematically shown in FIG. 25B, the non-dispersion drive process continuously performs the drive through the data in the first to fourth fields for first three lines and also for the next three lines.

The system of FIG. 23 is rather advantageous for the non-dispersion and slight dispersion drive processes while the system of FIG. 24 is advantageous for the complete and half-dispersion drive processes. However, the system of FIG. 23 can also realize the complete and half-dispersion drive when the miniaturization of the semiconductor process technique will in future be further advanced to produce a super-integrated circuit with a reduced cost.

11. ON/OFF Ratio

FIG. 27 shows a calculating formula representing the ON/OFF ratio in the drive process of the present embodiment. The term, $(n\times4/3-1)$ in this calculating formula represents an effective value applied to the liquid crystal during the non-selected period. The value, $n\times4/3$ is because the segment data is changed four times for displaying three lines.

Figure 28:
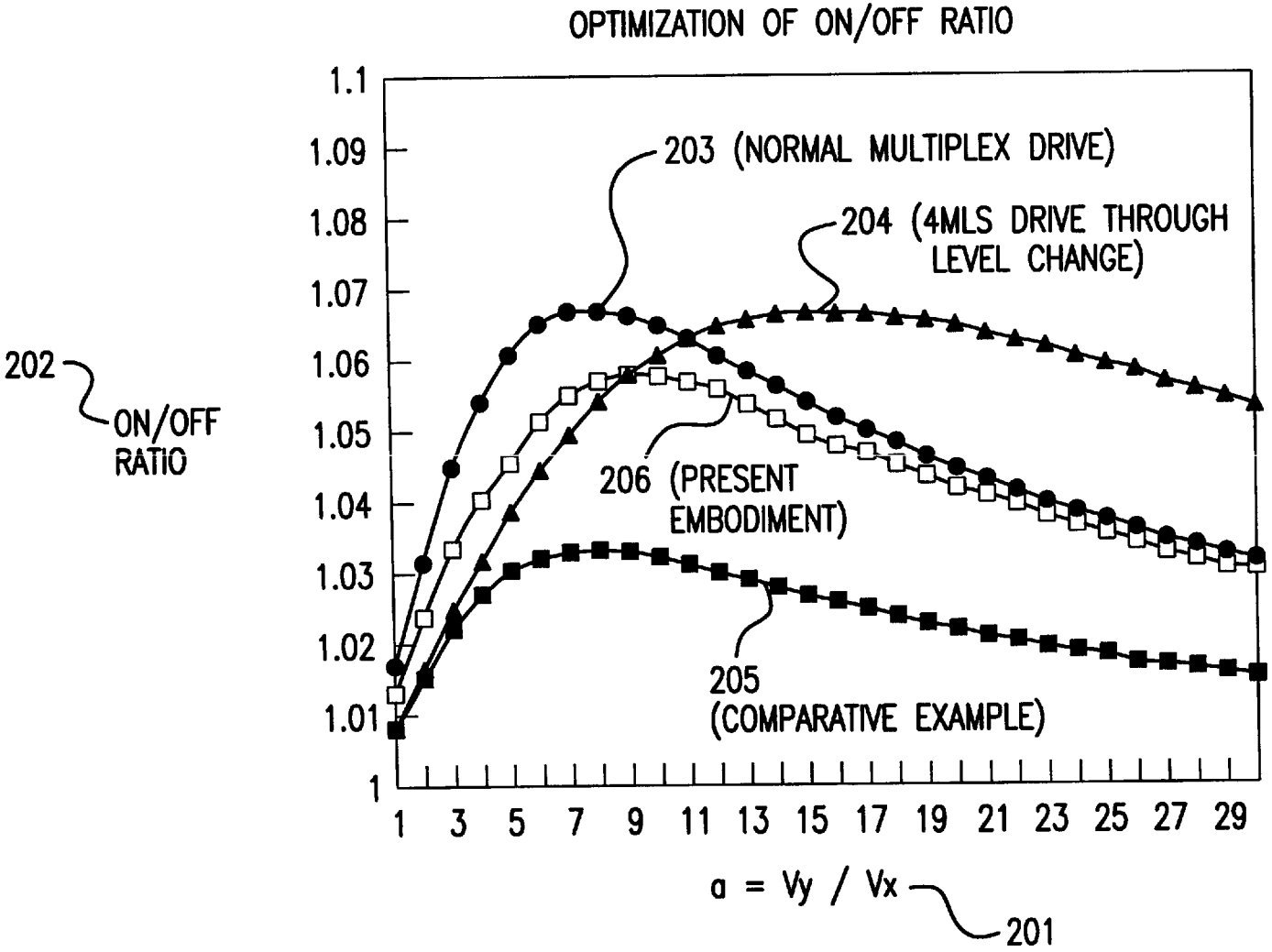
FIG. 28 is a graph illustrating the ON/OFF ratio characteristics in the prior art, comparative example and the present embodiment.

FIG. 28 shows a graph in which the characteristics of the ON/OFF ratio in the present embodiment are added to the graph of FIG. 8. 206 denotes the characteristics in the drive method of the present embodiment in which the drive is carried out through 3MLS plus virtual data.

According to the present embodiment, the ON/OFF ratio can be improved until 1.057 whereas the comparative example of FIG. 5 has its ON/OFF ratio equal to 1.034. This is inferior to the ON/OFF ratio equal to 1.067 in the normal multi-plexer driver and 4MLS drive through the change of level, but may have a sufficient level for use. The contrast is 31.7 in the normal multi-plex drive and 10.8 in the comparative example (complete dispersion) while the contrast in the drive method according to the present embodiment (complete dispersion) is increased to 35.9. The contrast obtained according to the present embodiment is actually reduced about 14% from the contrast of the conventional 4MLS drive method (complete dispersion) through the change of level which is equal to 41. However, the dispersion drive through the change of level can only realize the gray shading through the frame rate control or dither method when a liquid crystal having its increased response time is used. The frame rate control raises a problem in that a flicker tends to be caused. The dither method requires a calculation of area and cannot realize a highly fined display. The other drive method having a combination of the level change and PWM has a too large crosstalk and is not in any acceptable level. On the contrary, the drive method of the present embodiment will not create any flicker because of PWM. Therefore, the present embodiment can provide a highly fined display that has no flicker and is gentle to the user's eyes.

As described, the present embodiment provides the following advantages.

In the MLS drive method in which the prior art required a plurality of voltage levels (simultaneously selected number plus 1), the PWM drive can be carried out only with tow voltage levels. Thus, the present embodiment can always provide the same number of waveform changes, changed directions and changed amounts without depending on the display pattern, in comparison with the MLS drive method in which the gray shading was realized according to the prior art. Therefore, the number of waveform distortions can be reduced with the orientation of waveform change being clarified. Therefore, the present embodiment can adapt a technique of offsetting noise by changing the position of pulse division in the PWM backward and forward for each frame, for example. This can also reduce the stroke. Since only the number of voltage levels equal to two is required in the present embodiment, the number of parts in the power supply circuit can also be reduced while reducing the number of driver transistors in the IC of the segment driver. According to the present embodiment, further, the ON/OFF ratio or contrast can be improved while maintaining the aforementioned effects. Thus, the highly fined display which is gentle for the user's eyes can be realized without flicker.

In other words, an STN liquid crystal display panel can realize PWM gray shading without jitter or the like while reducing the crosstalk and minimizing any extreme reduction of contrast with a high-speed response about 100 ms. Since the circuit configuration is simplified, the semiconductor can more easily be integrated with reduction of the manufacturing cost.

The present invention is not limited to the aforementioned embodiment, but may be carried out in any of various forms without departing from the scope of the invention.

For example, the present invention is not limited to the form in which the memory stores the gray shades data for two lines. The calculation timing of the segment drivers may be determined by any external signal or GCP signal and the like. The screen may not be divided into two sections. Although the embodiment has been described as to the memory for storing the gray shades data corresponding to each line, the present invention is not limited to this form. The memories may be located within the display controller.

The calculating formula of FIG. 9 is simplified for illustration, but may be deformed by reducing the fraction or the like to the calculating formula or by dividing by four. This is apparently within the scope of the invention. The resulting data from the calculating formula of FIG. 9 may be obtained from any other calculating formula simplified in FIG. 16, for example.

The present invention is not limited to the present embodiment, but may be carried out in any of various other modification as far as the virtual data can be generated based on a plurality of gray shades data corresponding to a plurality of simultaneously selected scanning electrodes, a given calculation can be performed based on the gray shades data, the virtual data and an orthogonal function defining signals given to the scanning electrodes and the signals given to the signal electrodes during the selected period are subjected to pulse width modulation based on the resulting data from the given calculation. The generation of virtual data and processing the given calculation and so on may be realized in a software processing. Although the orthogonal function is usually represented by 1 and −1, the present invention is not limited to this form. For example, the calculation may be accomplished by proportionally multiplying the respective elements of the orthogonal function with a constant value.

What is claimed is:

1. A method of driving a liquid crystal display panel having scanning electrodes and signal electrodes through the multi-line selection drive method for simultaneously selecting a plurality of scanning electrodes, comprising the steps of:

generating a virtual data based on a gray shades data corresponding to said plurality of scanning electrodes to be simultaneously selected;

performing a given calculation based on said gray shades data, said virtual data and an orthogonal function defining signals to be given to the scanning electrodes; and pulse width modulating signals to be given to the signal electrodes during a selected period based on the resulting data from said given calculation, wherein data from said given calculation is obtained by converting said gray shades data and said virtual data into a data symmetrical about 0, performing a matrix calculation based on the converted data and an orthogonal function of i row and j column (wherein i and j are positive integers) and converting the result of the matrix calculation into a data represented only by a positive integer.

2. The method according to claim 1 wherein said virtual data is generated so that the sum of one of the number of 1 and 0 for each bit of said gray shades data which is binary represented and one of the number of 1 and 0 for each corresponding bit of said virtual data which is binary represented is even number.

3. The method according to claim 1 wherein the conversion of said gray shades data and said virtual data into a data symmetrical about 0 includes a conversion in which said gray shades data and said virtual data is multiplied by $2\times L$ and $(N-I)\times L$ is subtracted from the resulting value when it is assumed that the number of gray shades is N and an added number of scanning electrodes to be simultaneously selected and virtual data is L.

4. The method according to claim 1 wherein the conversion of the result of the matrix calculation into a data represented only by the positive integer includes a conversion in which $L\times(N-1)\times L/2$ is added to the result of the matrix calculation and the resulting value being divided by L when it is assumed that the number of gray shades is N and an added number of scanning electrodes to be simultaneously selected and virtual data is L.

5. A method of driving a liquid crystal display panel having scanning electrodes and signal electrodes through the multi-line selection drive method for simultaneously selecting a plurality of scanning electrodes, comprising the steps of:

generating a virtual data based on a gray shades data corresponding to said plurality of scanning electrodes to be simultaneously selected;

performing a given calculation based on said gray shades data, said virtual data and an orthogonal function defining signals to be given to the scanning electrodes; and pulse width modulating signals to be given to the signal electrodes during a selected period based on the resulting data from said given calculation, wherein said given calculation comprises:

a matrix calculation based on said gray shades data, said virtual data and an orthogonal function of i row and i column (wherein i and J are positive integers); and an add calculation based an a result of the matrix calculation and a constant depending on the total sum of the row elements of the orthogonal function.

6. The method according to claim 5 wherein said constant depending on the total sum of the row elements in the orthogonal function is $-(N-1)\times S+(N-1)\times L/2$ when it is assumed that the total sum of the row elements in the orthogonal function is S and the number of gray shades is N.

7. A method of driving a liquid crystal display panel having scanning electrodes and signal electrodes through the multi-line selection drive method for simultaneously selecting a plurality of scanning electrodes, comprising the steps of:

generating a virtual data based on a gray shades data corresponding to said plurality of scanning electrodes to be simultaneously selected;

performing a given calculation base don said gray shades data, said virtual data and an orthogonal function defining signals to be given to the scanning electrodes; and pulse width modulating signals to be given to the signal electrodes during a selected period based an the resulting data from said given calculation, wherein the number of time divisons in the pulse width modulation during said selected period is (N−1) when it is assumed that the number of gray shades is N and a sum of the number of scanning electrodes to be simultaneously selected and the number of virtual data is L which is equal to four.

8. A segment driver for driving signal electrodes through a multi-line selection drive method for simultaneously selecting a plurality of scanning electrodes, comprising:

means for generating a virtual data based on a gray shades data corresponding to said plurality of scanning electrodes to be simultaneously selected;

means for performing a given calculation base don said gray shades data, said virtual data and an orthogonal function defining signals to be given to the scanning electrodes; and means for pulse width modulating signals to be given to the signal electrodes during a selected period based on the resulting data from said given calculation, wherein data from said given calculation is obtained by converting said gray shades data and said virtual data into a data symmetrical about 0, performing a matrix calculation based on the converted data and an orthogonal function of i row and i column (wherein i and j are positive integers) and converting the result of the matrix calculation into a data represented only by a positive integer.

9. The segment driver according to claim 8 wherein said means for generating said virtual data generates said virtual data so that the sum of one of the number of 1 and 0 for each bit of said gray shades data which is binary represented and one of the number of 1 and 0 for each corresponding bit of said virtual data which is binary represented is even number.

10. A segment driver for driving signal electrodes through a multi-line selection drive method for simultaneously selecting a plurality of scanning electrodes, comprising:

means for generating a virtual data based on a gray shades corresponding to said plurality of scanning electrodes to be simultaneously selected;

means for performing a given calculation based on said gray shades data, said virtual data and an orthogonal function defining signals to be given to the scanning electrodes; and means for pulse with modulating signals to be given to the signal electrodes during a selected period based on the resulting data form said given calculation, wherein said given calculation comprises:

a matrix calculation based on said gray shades data, said virtual data and an orthogonal function of i row and j column (wherein i and j are positive integers); and an add calculation based on a result of the matrix calculation and a constant depending on the total sum of the row elements of the orthogonal function.

11. The segment driver according to claim 8, further comprising a line memory for holding the gray shades data corresponding to lines equal to or more than two times LM which is the number of scanning electrodes to be simultaneously selected.

12. The segment driver according to claim 11 wherein said means for generating said virtual data comprises:

a logic circuit for performing AND operation of a pulse signal delayed by a specific period relative to the read timing of said line memory and an output signal from said line memory; and a toggle flip-flop initialized before the matrix calculation through said orthogonal function is started, said toggle flip-flop having a clock terminal for receiving the output of said logic circuit and an output terminal for outputting said virtual data.

13. A display controller for supplying signals to a segment driver for driving signal electrodes and a common driver for driving scanning electrodes through the multi-line selection drive method which simultaneously selects a plurality of scanning electrodes, said display controller comprising:

means for fetching a gray shades data;

means for writing the fetched gray shades data into a line memory which is able to hold a gray shades data corresponding to lines equal to or more than two times the number of simultaneously selected scanning electrodes;

means for reading the written gray shades data from said line memory;

means for generating a virtual data based on a gray shades data corresponding to a plurality of simultaneously selected scanning electrodes;

means for performing a given calculation based on said gray shades data, said virtual data and an orthogonal function defining signals to be given to the scanning electrodes;

means for supplying the resulting data from said given calculation to the segment driver which pulse width modulates signals to be given to the signal electrodes during a selected period based on said resulting data; and means for supplying the orthogonal function to the common driver, wherein data from said given calculation is obtained by converting said gray shades data and said virtual data into a data symmetrical about 0, performing a matrix calculation based on the converted data and an orthogonal function of i raw and i column (wherein i and j are positive integers) and converting the result of the matrix calculation into a data represented only by a positive integer.

14. The display controller according to claim 13 wherein said means for generating said virtual data generates the virtual data so that the sum of one of the number of 1 and 0 for each bit of said gray shades data which is binary represented and one of the number of 1 and 0 for each corresponding bit of said virtual data which is binary represented is even number.

15. A display controller for supplying signals to a segment driver for driving signal electrode and a common driver for driving scanning electrodes through the multi-line selection drive method which simultaneously selects a plurality of scanning electrodes, said display controller comprising:

means for fetching a gray shades data;

means for writing the fetched gray shades data into a line memory which is able to hold a gray shades data corresponding to lines equal to or more than two times the number of simultaneously selected scanning electrodes;

means for reading the written gray shades data from said line memory;

means for generating a virtual data based on a gray shades data corresponding to a plurality of simultaneously selected scanning electrodes;

means for performing a given calculation based on said gray shades data, said virtual data and an orthogonal function defining signals to be given to the scanning electrodes;

means for supplying the resulting data from said given calculation to the segment driver which pulse width modulates signals to be given to the signal electrodes during a selected period based on said resulting data; and means for supplying the orthogonal function to the common driver, wherein said given calculation comprises:

a matrix calculation based on said gray shades data, said virtual data and an orthogonal function at i row and i column (wherein i and i are positive integers); and an add calculation based on a result of the matrix calculation and a constant depending on the total sum of the row elements of the orthogonal function.

16. A display controller for supplying signals to a segment driver for driving signal electrodes and a common driver for driving scanning electrodes through the multi-line selection drive method which simultaneously selects a plurality of scanning electrodes, said display controller comprising:

means for fetching a gray shades data;

means for writing the fetched gray shades data into a line memory which is able to hold a gray shades data corresponding to lines equal to or more than two times the number of simultaneously selected scanning electrodes;

means for reading the written gray shades data form said line memory;

means for generating a virtual data based on a gray shades data corresponding to a plurality of simultaneously selected scanning electrodes;

means for performing a given calculation based on said gray shades data, said virtual data and an orthogonal function defining signals to be given to the scanning electrodes;

means for supplying the resulting data from said given calculation to the segment driver which pulse width modulates signals to be given to the signal electrodes during a selected period based on said resulting data; and means for supplying the orthogonal function to the common driver, wherein T2=mx (LM/L) XT1 (m being a positive integer) when it is assumed that LM is the number of simultaneously selected scanning electrodes; L is the sum of LM and the number of virtual data; T1 is a cycle time for writing said gray shades data into said line memory; and T2 is a cycle time for outputting data to the segment driver.

17. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver as defined in claim 9 for driving the signal electrodes; and a common driver for driving the scanning electrodes.

18. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver for driving the signal electrodes through the pulse width modulation;

a common driver for driving the scanning electrodes; and a display controller as defined in claim 15 for supplying signals to said segment driver and said common driver.

19. The segment driver according to claim 8 wherein the conversion of said gray shades data and said virtual data into a data symmetrical about 0 includes a conversion in which said gray shades data and said virtual data is multiplied by 2×L and (N−I)×L is subtracted from the resulting value when it is assumed that the number of gray shades is N and an added number of scanning electrodes to be simultaneously selected and virtual data is L.

20. The segment driver according to claim 8 wherein the conversion of the result of the matrix calculation into a data represented only by the positive integer includes a conversion in which L×(N−1)×L/2 is added to the result of the matrix calculation and the resulting value being divided by L when it is assumed that the number of gray shades is N and an added number of scanning electrodes to be simultaneously selected and virtual data is L.

21. The segment driver according to claim 10 wherein said constant depending on the total sum of the row elements in the orthogonal function is −(N−I)×S+(N−1)×L/2 when it is assumed that the total sum of the row elements in the orthogonal function is S and the number of gray shades is N.

22. A segment driver for driving signal electrodes through a multi-line selection drive method for simultaneously selecting a plurality of scanning electrodes, comprising:

means for generating a virtual data based on a gray shades data corresponding to said plurality of scanning electrodes to be simultaneously selected;

means for performing a given calculation based on said gray shades data, said virtual data and an orthogonal function defining signals to be given to the scanning electrodes; and means for pulse width modulating signals to be given to the signal electrodes during a selected period based on the resulting data from said given calculation, wherein the number of time divisions in the pulse with modulation during said selected period is (N−1) when it is assumed that the number of gray shades is N and a sum of the number of scanning electrodes to be simultaneously selected and the number of virtual data is L which is equal to four.

23. The display controller according to claim 13 wherein the conversion of said gray shades data and said virtual data into a data symmetrical about 0 includes a conversion in which said gray shades data and said virtual data is multiplied by 2×L and (N−I)×L is subtracted from the resulting value when it is assumed that the number of gray shades is N and an added number of scanning electrodes to be simultaneously selected and virtual data is L.

24. The display controller according to claim 13 wherein the conversion of the result of the matrix calculation into a data represented only by the positive integer includes a conversion in which L×(N−1)×L/2 is added to the result of the matrix calculation and the resulting value being divided by L when it is assumed that the number of gray shades is N and an added number of scanning electrodes to be simultaneously selected and virtual data is L.

25. The display controller according to claim 15 wherein said constant depending on the total sum of the row elements in the orthogonal function is −(N−I)×S+(N−1)×L/2 when it is assumed that the total sum of the row elements in the orthogonal function is S and the number of gray shades is N.

26. A display controller for supplying signals to a segment driver for driving signal electrodes and a common driver for driving scanning electrodes through the multi-line selection drive method which simultaneously selects a plurality of scanning electrodes, said display controller comprising:

means for fetching a gray shades data;

means for writing the fetched gray shades data into a line memory which is able to hold a gray shades data corresponding to lines equal to or more than two times the number of simultaneously selected scanning electrodes;

means for reading the written gray shades data form said line memory;

means for generating a virtual data based on a gray shades data corresponding to a plurality of simultaneously selected scanning electrodes;

means for performing a given calculation based on said gray shades data, said virtual data and an orthogonal function defining signals to be given to the scanning electrodes;

means for supplying the resulting data from said given calculation to the segment driver which pulse width modulates signals to be given to the signal electrodes during a selected period based on said resulting data; and means for supplying the orthogonal function to the common driver;

wherein the number of time divisions in the pulse width modulation during said selected period is (N−1) when it is assumed that the number of gray shades is N and a sum of the number of scanning electrodes to be simultaneously selected and the number of virtual data is L which is equal to four.

27. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver as defined in claim 10 for driving the signal electrodes; and a common driver for driving the scanning electrodes.

28. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver as defined in claim 22 for driving the signal electrodes; and a common driver for driving the scanning electrodes.

29. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver for driving the signal electrodes through the pulse width modulation;

a common driver for driving the scanning electrodes; and a display controller as defined in claim 15 for supplying signals to said segment driver and said common driver.

30. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver for driving the signal electrodes through the pulse width modulation;

a common driver for driving the scanning electrodes; and a display controller as defined in claim 16 for supplying signals to said segment driver and said common driver.

31. A liquid crystal display device for driving a liquid crystal display panel through the multi-line selection drive method simultaneously selecting a plurality of scanning electrodes, said liquid crystal display device comprising:

a liquid crystal display panel having scanning and signal electrodes;

a segment driver for driving the signal electrodes through the pulse width modulation;

a common driver for driving the scanning electrodes; and a display controller as defined in claim 26 for supplying signals to said segment driver and said common driver.

* * * * *